United States Patent [19]

Umezawa

[11] Patent Number: 4,660,825

[45] Date of Patent: Apr. 28, 1987

[54] SHEET CLAMPING DEVICE

[75] Inventor: Michio Umezawa, Kawasaki, Japan

[73] Assignee: Ricoh Company Ltd., Tokyo, Japan

[21] Appl. No.: 173,189

[22] Filed: Jul. 25, 1980

[30] Foreign Application Priority Data

| | | | |
|---|---|---|---|
| Jul. 26, 1979 | [JP] | Japan | 54-095318 |
| Jul. 30, 1979 | [JP] | Japan | 54-097096 |
| Jul. 30, 1979 | [JP] | Japan | 54-097097 |
| Jul. 30, 1979 | [JP] | Japan | 54-097099 |
| Jan. 30, 1980 | [JP] | Japan | 55-009748 |
| Mar. 18, 1980 | [JP] | Japan | 55-034605 |

[51] Int. Cl.[4] ..... B65H 39/10

[52] U.S. Cl. ..... 271/276; 271/277; 271/5

[58] Field of Search ..... 271/276, 277, 176, 82, 271/247, 3, 4, 5, 274; 346/138; 101/409, 410, 411, 412

[56] References Cited

U.S. PATENT DOCUMENTS

| | | | |
|---|---|---|---|
| 2,165,231 | 7/1939 | Curtis | 271/247 X |
| 2,747,503 | 5/1956 | Fors | 271/82 X |
| 3,178,179 | 4/1965 | Maclean | 271/196 |
| 3,239,215 | 3/1966 | Davis et al. | 271/277 |
| 3,869,202 | 3/1975 | Tabata et al. | 271/3 X |
| 3,944,218 | 3/1976 | Cerny | 271/277 |
| 4,029,009 | 6/1977 | Kuhn et al. | 271/276 X |
| 4,135,198 | 1/1979 | Fujimoto | 346/138 |
| 4,147,128 | 4/1979 | Muller | 271/276 X |
| 4,180,255 | 12/1979 | Himmel | 271/277 X |
| 4,202,542 | 5/1980 | Lammers et al. | 271/276 |
| 4,203,588 | 5/1980 | Joosten | 271/274 X |
| 4,237,466 | 12/1980 | Scranton | 271/276 X |
| 4,250,810 | 2/1981 | Fowler et al. | 101/410 |
| 4,252,307 | 2/1981 | Korte | 271/276 X |

*Primary Examiner*—Joseph J. Rolla

*Attorney, Agent, or Firm*—Wyatt, Gerber, Shoup, Scobey and Badie

[57] ABSTRACT

A sheet is disposed around the outer peripheral surface of a drum. The drum is provided with sheet suction holes for attracting the sheet against the drum surface. The sheet suction holes extend through the drum from the interior to the exterior thereof, and are disposed in a plurality of circumferentially spaced rows. Each of the rows includes a plurality of sheet suction holes and is connected to suction means, which is operable to withdraw air outside the drum into the interior thereof through the row of suction holes. At least the leading edge of the sheet is retained by a sheet seizing claw which is movable toward or away from the drum surface. The claw is urged into abutment against the drum surface under the influence of a centrifugal force as the drum rotates.

58 Claims, 39 Drawing Figures

1
2
3
4
5
6
7
8
8A
9
10
11
12
13
14
15
16
17
18
S 20
21
22
23
24
24a
24b
25
26
27
28
29
30
31
32
33
34
35
36
37
38
49
50
54
56

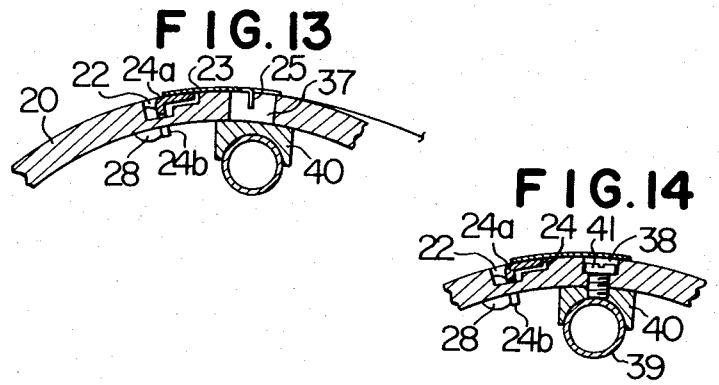
FIG. 13
FIG. 14
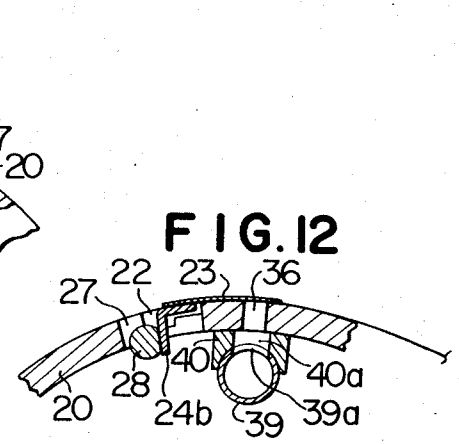
FIG. 12
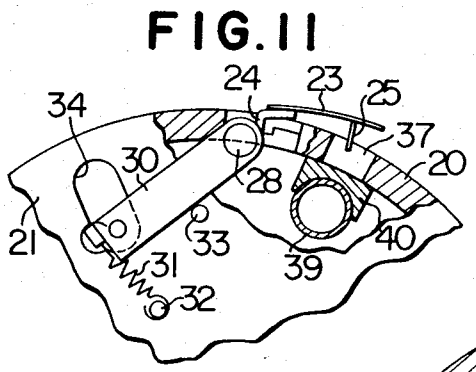
FIG. 11
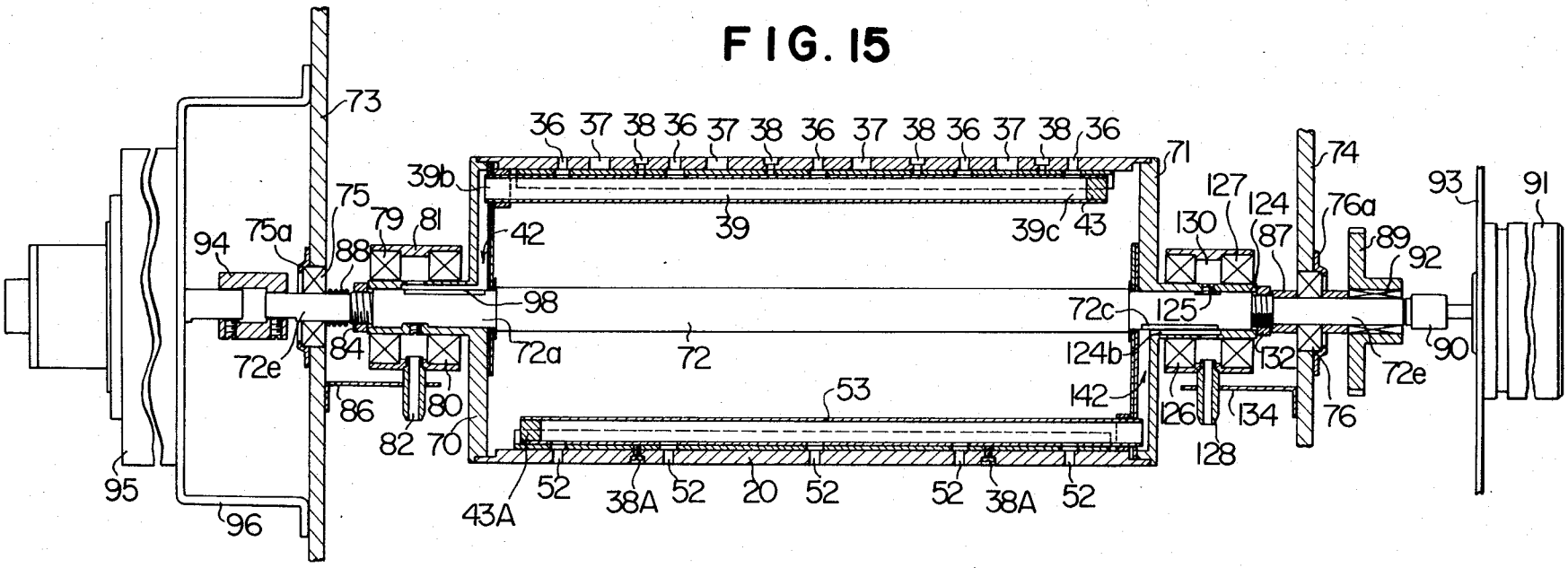
FIG. 15

SHEET CLAMPING DEVICE

BACKGROUND OF THE INVENTION

The invention relates to a sheet clamping device for wrapping and fixing a sheet-shaped material around a drum.

Various apparatus utilize a sheet-shaped material which is wrapped around a drum, including a master sheet loading device in an offset printing machine, an apparatus for loading an original to be transmitted as the record paper in a facsimile system; an arrangement for mounting a sheet-shaped photosensitive material in a copying machine or the like. A variety of such apparatus have been proposed and are in practical use.

A conventional sheet clamping technique relies on a mechanical arrangement utilizing a complex combination of cams and levers, resulting in a complex mechanism and requiring a high accuracy of the parts used. Hence, an increased cost results disadvantageously. In addition to the problem of increased cost, an increased number of parts require a complex operation for the mechanism, giving rise to the likelihood of an erroneous clamping action, disengagement of a sheet from the drum and a resulting likelihood of a sheet jamming. To summarize, such arrangements do not result in a sheet clamping device having a high reliability.

In one of the sheet clamping techniques, the drum surface is formed with a multitude of holes so that air can be withdrawn into the interior of the drum, thereby clamping a sheet thereon by the partial vacuum formed within the drum. In this technique, the area of the drum on which a sheet is disposed is formed with a number of holes to permit air to be withdrawn therethrough and to attract a sheet to the drum surface in response to a negative pressure applied to the interior of the drum at the same timing as a sheet is supplied to the drum. However, the arrangement must have the capability to withdraw a large quantity of air through the holes of the suction of the air through all the holes. This often prevents a sufficient negative pressure from being building up within the drum because when the leading end of a sheet is being attracted to the drum, the remaining holes are still left open, thereby resulting in a reduced clamping action of the leading end by the air suction. As a result, a vacuum pump of an increased size must be used, leading to an increased size of the overall apparatus, an increased cost and a higher level of noise.

It is to be understood that in an apparatus in which a sheet is wrapped and fixed around the drum, such as a facsimile system, a variety of operations take place as the drum rotates, so that it is necessary that the drum undergoes a precise rotation and that such rotation be accurately detected.

Where the air suction takes place through the end of a flange on the drum in order to establish a negative pressure within the drum, a motor which drives the drum for rotation cannot be directly coupled thereto, but a transmission mechanism such as gears must be used to rotate the drum. In addition, an encoder which is used to detect the rotation of the drum cannot be directly coupled therewith. Thus, the use of such a drive transmission mechanism may cause an adverse influence upon the rotation of the drum or may prevent a precise detection of the timing of rotation. By way of example, if gears and a belt are used to rotate the drum, a nonuniform rotation may result due to backlashes or oscillations occurring in the belt. If the encoder is coupled to the drum through the gears and belt, a nonuniform rotation may often result, preventing the exact timing from being determined.

A nonuniform rotation of a drum or a failure to detect such rotation are reflected in the degradation of an image quality, which is critical in an apparatus which is used to record an image.

In a sheet clamping device of a suction type, a plurality of sheets having different sizes may be selectively retained on the drum, by providing a plurality of row of holes, each including a plurality of suction holes, along the generatrix of the drum in a manner corresponding to the various sizes of the sheets, and applying a negative pressure to a selected row or rows of suction holes. It will be seen that the number of rows of suction holes be preferably reduced as much as possible while those rows of suction holes which are to be used in common be activated together in order to facilitate the construction of a channel which introduces the negative pressure to the respective rows of such holes and their associated switching devices. However, when those rows of suction holes connected in common are associated with sheets having different lateral sizes or widths, namely, having different sizes along the generatrix of a drum as they are disposed therearound, a difficulty results in that if these suction holes are located in a region corresponding to the minimum width of the associated sheets, the lateral regions of a sheet having a greater width cannot be sufficiently attracted to the drum. On the contrary, if these suctions holes are distributed in a range corresponding to the maximum width of the sheets, a sheet having a smaller width cannot be sufficiently attracted or held to the drum as a result of a leakage of the negative pressure through those suction holes located in the axial end regions of the drum.

What is demanded of a sheet clamping device of either type is to clamp a sheet in a positive manner and in close contact with the drum surface without producing any slack therein. If part of the sheet is partly removed from the drum surface, a distance between the sheet and its associated processing mechanism such as an ink jet head of a printing machine of ink jet recording type or a read head of a facsimile system may change, preventing an exact printing or reading operation from being achieved.

In particular, in a sheet clamping device of the type in which a sheet is fed underneath a sheeting seizing claw disposed on the drum surface to have its end clamped thereby while the drum is in rotation, the sheet is conveyed with a velocity greater than the peripheral velocity of the drum in order to assure a positive abutment of the sheet against the claw, so that it is likely that the leading end of the sheet may be forced away from the drum surface.

Also, a device including a sheet seizing claw must be provided with a mechanism which reliably closes the claw whenever the leading end of the sheet is to be clamped.

SUMMARY OF THE INVENTION

In view of the foregoing, it is a first object of the invention to provide a sheet clamping device having a minimized mechanical operation while enabling a sheet to be clamped through air suction with a vacuum pump of a reduced capacity and size, and hence with reduced noise.

This object of the invention is achieved by a sheet clamping device for disposing a sheet around the drum in which a plurality of circumferentially spaced rows of sheet suction holes are formed in the drum to provide a communication between the interior and the exterior of a drum surface around which a sheet is disposed, these rows of suction holes having openings which are located inside the drum and which are connected with suction means through a controller for controlling the application of the suction to the suction holes, thereby applying a suction to the sheet at a plurality of locations from inside the drum at a suitable timing, thus withdrawing the external air into the drum.

In accordance with the invention, there are provided rows of suction holes which separately attract a plurality of areas of a sheet, for example, the leading and the trailing end thereof. By applying a suction to those suction holes which attract the leading end at a timing which is distinct from that of applying suction to those suction holes which attract the trailing end, the amount of air suction can be maintained constant and reduced to the required minimum. In this manner, the use of a vacuum pump of a small size and a small capacity is permitted, enabling a reduction in the cost. In addition, the generation of noises can advantageously be reduced. When clamping the sheet through the air suction, a sheet seizing claw which seizes the leading end of the sheet is operated to its closed position in response to the air suction applied, whereby the provision of a separate mechanical opening and closing mechanism can be dispensed with for the sheet seizing claw, which requires a delicate and reliable operation. In this manner, a sheet clamping device having a high reliability and a reduced number of parts is provided.

It is a second object of the invention to provide a sheet clamping device which is simple in construction, inexpensive to manufacture and reliable in operation, by minimizing parts which require mechanical operation.

This object of the invention is achieved by providing a sheet clamping device including a sheet seizing claw which is disposed in parallel relationship with a drum shaft so that an end of a sheet may be held against the drum surface and in which a plurality of suction holes are formed to extend through the drum in a region of the sheet and captured by the sheet seizing claw so as to provide a communication between the interior and the exterior of the drum and in which suction means is provided for connection with the suction holes. By applying a suction from the suction means to the suction holes in order to withdraw the external air, the sheet can be held against the drum surface in cooperation with the action of the sheet seizing claw.

According to the invention, a mechanical mechanism which opens and closes the sheet seizing claw, requiring a delicate and reliable operation, is dispensed with while allowing the claw to be operated pneumatically or through air suction. In this manner, the number of parts required is reduced, and the construction is simplified, thus enabling a reduction in the cost.

Thus, it is a feature of the invention that the air is withdrawn from the interior of the drum to attract the sheet in close contact against the drum surface and that the sheet seizing claw is also pneumatically attracted to its closed position, thereby retaining the sheet end.

It is a third object of the invention to provide a sheet clamping device having a minimized number of component parts while allowing a sheet to be positively clamped in place by air suction which is supplied from suction means of a reduced size and a reduced capacity.

This object of the invention is achieved by providing a sheet clamping device comprising a drum around which a sheet is disposed, a plurality of rows of suction holes formed to extend through the drum so as to provide a communication between the interior and the exterior of the drum to attract at least the leading and the trailing end of the sheet against the drum, a suction pipe associated with each row of suction holes, a rotating shaft substantially integral with the drum, and air passage extending axially through the shaft and having its one end connected with the suction pipe and its other end opening into the end face of the shaft, and suction means connected to the other end of the air passage.

According to the invention, instead of providing sheet attracting suction holes around the full periphery of the drum, rows of suction holes are provided which are operable to attract at least the leading and the trailing end of the sheet. Accordingly, the associated suction means may be one of a reduced capacity and hence a reduced size, with the level of noises produced being reduced. The air passage which communicates the suction means with the rows of suction holes extend through the rotating shaft of the drum, and hence can be easily sealed, simplifying the arrangement and allowing a reduction in the cost.

It is a fourth object of the invention to provide a sheet clamping device in which a drum drive motor and an encoder are directly coupled with a rotating shaft of the drum, thereby permitting a drum drive and a signal generation with a high accuracy.

This object of the invention is achieved by providing a sheet clamping device having plurality of suction holes formed in the periphery of the drum to provide a communication between the interior and the exterior of the drum and to which a suction is applied from inside the drum to attract at least the leading end of the sheet against the drum, the device comprising a suction pipe disposed within the the drum and communicating with the suction holes, a first air passage formed in a flange of the drum and having its one end disposed in communication with the suction pipe, a second air passage formed in a rotating shaft which is substantially integral with the drum and having its one end disposed in communication with the first air passage and its other end opening into the periphery of the shaft, non-rotatable connection means disposed in surrounding relationship with openings formed in the peripheral surface of the second air passage, the drum shaft being rotatably disposed inside the connection means, and suction means connected to the connection means.

According to the invention, the suction holes which are formed in the peripheral surface of the drum to attract the sheet are limited to those which attract at least the leading end, or preferably both the leading and the trailing end, of the sheet. This allows the capacity and the size of a suction pump used to be reduced, contributing to a compact construction of the device. Since the air passage which communicates the suction means with the suction holes has its one opening into the peripheral surface of the drum shaft, on which the non-rotatable connection means is disposed in the region of the opening, it is possible to mount any desired assembly on the drum shaft in regions other than the opening region. By way of example, a drum drive motor may be directly coupled with the drum shaft, enabling an accurate and uniform drum rotation. Also, an encoder may be mounted on the drum shaft. In this instance, the encoder can be considered as integral with the drum, so that it is capable of detecting the drum rotation with a high accuracy to provide an accurate timing signal.

It is a fifth object of the invention to provide a sheet clamping device having a mininmized number of rows of suction holes which are selectively operable to attract sheets of various sizes to be attracted to the drum without accompanying any inconvenience.

This object of the invention is achieved by providing a sheet clamping device having a plurality of rows of suction holes disposed along the generatrix of the drum for attracting the leading and the trailing end of a sheet of varying size against the drum surface, the suction holes being distributed in a range which corresponds to the width of the respective sheets. Those suction holes used to attract the leading end of the sheet which correspond to a sheet of a given width are connected in common while the suction holes corresponding to a sheet of a different width are located at circumferentially spaced positions.

It is a sixth object of the invention to provide a sheet clamping device having a high reliability and preventing any displacement or dislodgement of a sheet from the drum if the latter rotates at a higher speed.

This object of the invention is achieved by providing a sheet clamping device including a support shaft which is pivotally mounted on a flange of a drum around which the sheet is to be disposed, and a sheet seizing claw having its one end mounted on the support shaft in substantially integral manner and having its free end disposed to be movable toward or away from the drum surface, the sheet clamping device being characterized by the provision of a weight which is movable in one direction in response to a centrifugal force which is developed as the drum rotates, and connection means connected to the weight and the support shaft for rotating the support shaft in a direction to increase the seizing effect of a sheet seizing claw as the latter cooperate with the drum surface in response to a movement of the weight. Similarly, the same object can be achieved by providing a sheet clamping device including a drum which is adapted to be selectively rotated at a low or a high speed, a plurality of holes formed to provide a communication between the interior and the exterior of the drum for withdrawing air to attract a sheet end against the drum surface, and a sheet seizing claw for clamping the sheet end which is attracted through the hole, the sheet clamping device being characterized by the provision of a sheet seizing claw disposed so as to be movable toward or away from the drum surface and normally urged to be removed from the drum surface, a weight adapted to be moved away from the center of the drum in response to a centrifugal force which is developed as the drum rotates at a high speed, and connection means for moving the sheet seizing claw in a direction toward the drum surface as the weight moves away from the center of the drum, the sheet seizing claw assuming an open position during a low speed rotation and assuming a closed position during a high speed rotation of the drum.

According to the invention, no separate source of power is provided in order to increase the sheet seizing effect, but the centrifugal force which acts on the weight as the drum rotates is utilized, thus reducing the number of parts required and simplifying the construction. Consequently, the cost is reduced while maintaining a desired clamping effect during the rotation of the drum.

Since according to the invention, the leading end of the sheet is attracted by the suction applied through the suction holes, and the sheet seizing claw is urged in a direction to hold the leading end of the sheet against the drum in response to the centrifugal force during a high speed rotation of the drum, a displacement or a dislodgement of the sheet is prevented, thus increasing the reliability of the sheet clamping device.

Thus, it is another feature of the invention that the sheet seizing claw which holds the sheet by cooperating with the drum surface is connected with weight through a rockable shaft so that a movement of the weight in response to a centrifugal force developed during the rotation of the drum causes the connection means to turn the claw angularly, thus enabling the sheet seizing effect.

It is a seventh object of the invention to provide a sheet clamping device capable of reliably closing the sheet seizing claw and bringing the sheet into close contact with the drum surface without forming any slack therein, by merely adding a simple mechanism.

This object of the invention is achieved by providing a sheet clamping device including a sheet seizing claw disposed in parallel relationship with a drum shaft and operable to clamp a sheet end, a plurality of sheet attracting holes providing a communication between the interior and the exterior of the drum for attracting a sheet against the drum, and suction means connected to the holes so that as a sheet is fed into alignment with the drum surface, it is held against the drum surface by means of the claw and the sheet attracting holes, the sheet clamping device being characterized by the provision of a rotatable roller disposed in parallel relationship with the drum shaft and movable toward or away from the drum surface and selectively positioned at a first position in which it is removed from the drum surface and a second position in which it is brought in abutment against the drum surface to urge the sheet seizing claw to its closed position and also to urge the sheet against the drum surface, and drive means for selectively locating the roller to its first and second positions.

According to the invention, immediately after the claw has held the leading end of a sheet, the roller bears against it to maintain it firmly in its closed position. Subsequently, the roller urges the sheet against the drum surface so as to bring the sheet into close contact with the drum surface and, therefore, functions as a hold-down device. As a consequence, inconveniences such as a dislodgement of the sheet from the drum or a variation in the distance between the sheet and an ink jet head, for example, are eliminated.

Since it is unnecessary to rely entirely upon the air suction to operate the sheet seizing claw to its closed position, the suction means or a vacuum pump may have a reduced capacity and hence a reduced size, thus advantageously reducing the space requirement and noises produced.

BRIEF DESCRIPTION OF THE DRAWINGS

FIG. 11 is a side elevation, partly cut away, illustrating a sheet seizing claw in its open position.

FIG. 12 is a cross section taken along the line A—A shown in FIG. 6.

FIG. 13 is a cross section taken along the line B—B shown in FIG. 6.

FIG. 14 is a cross section taken along the line C—C shown in FIG. 6.

FIG. 15 is a cross section of one form of a drum drive mechanism.

DESCRIPTION OF EMBODIMENTS

Figure 1:
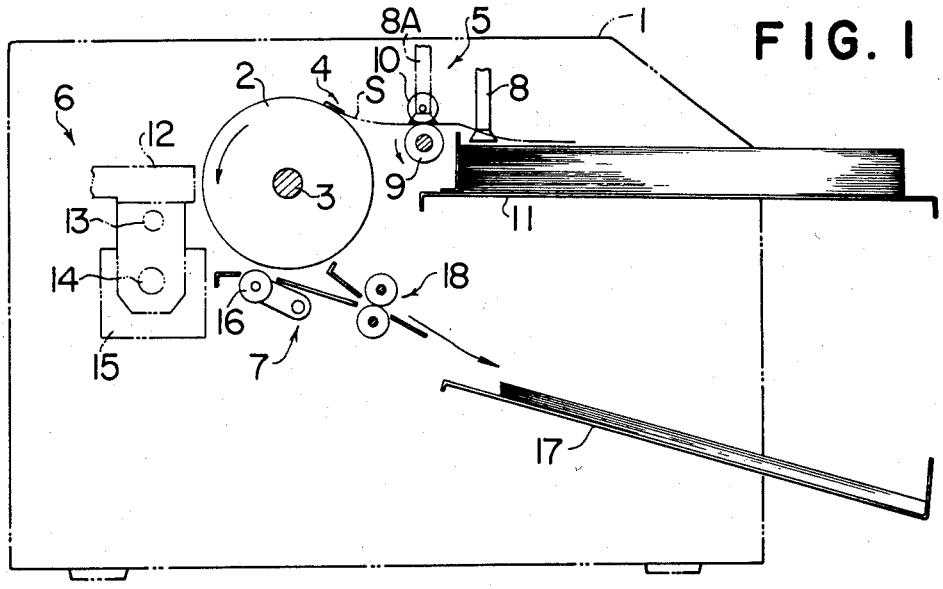
FIG. 1 is a schematic view of a printing apparatus of an ink jet recording type, which is shown as an example of an arrangement to which the invention may be applied.

Referring to the drawings, the invention will now be described in detail. In the description to follow, the invention is described as applied to a printing apparatus of an ink jet recording type, as an example of an apparatus in which a sheet is disposed and fixed around the drum. Hence, the term "sheet" which appears in the following description refers to a printing sheet, but it should be understood that in its broader sense, the term "sheet" as used in the invention may include any sheet shaped material which is to be held against the drum, including a printing sheet used in printing apparatus of other types, a master sheet used in an offset printing machine, an original to be transmitted and a record sheet used in a facsimile system, a transfer sheet used in a duplicating machine or the like.

Referring to FIG. 1, the printing apparatus includes a casing 1 in which a drum 2 is rotatably mounted on a support shaft 3. The drum 2 is provided with a sheet seizing claw 4 to be described later in more detail. A paper feeder 5, a recorder 6, and a paper delivery unit 7 are disposed around the drum in the sequence named, as viewed in the direction of rotation of the drum. The paper feeder 5 comprises an automatic feeder of the suction type which is well known in itself. It comprises a suction device 8, a delivery roller 9, an idle roller 10 and a sheet receptacle 11. The suction device 8 normally assumes a home position indicated by phantom lines 8A, but moves to a solid line position during a feeding operation, and after it has attached a sheet S at the solid line position, it again returns to the phantom line position. A mechanism which causes the suction device 8 to operate in the manner mentioned above as well as the associated suction means are not shown. As the suction device 8 returns to its phantom line position carrying the sheet S, the idler roller 10 is removed from the delivery roller 9, and returns to the position shown at a given time interval after the suction device 8 has returned to the phantom line position, thus holding the sheet S between it and the delivery roller 9. The drum 2 rotates at a relatively low speed, and as the delivery roller 9 is driven for rotation in synchronized relationship with the location of the sheet seizing claw 4 on the drum, the sheet S is fed toward the drum 2 to have its leading end inserted between the claw 4 and the drum surface. Subsequently, the claw 4 is closed by means, not shown, thus completing a clamping operation for the leading end of the sheet. After the leading end of the sheet is clamped, the latter is brought into close contact with the drum surface over its entire length, whereupon its trailing end is also clamped by another clamping means, not shown.

The recorder 6 comprises an ink jet head 12 located adjacent the drum surface, a guide shaft 13, a drive shaft 14 which comprises a screw shaft, and a controller, not shown. Both the guide shaft 13 and the drive shaft 14 are disposed to extend parallel to the support shaft 3 associated with the drum. The ink jet head 12 is driven for movement along the direction of the generatrix along the drum surface (sub-scanning direction), by means of the drive shaft 14 which is driven by a drive motor 15. Since the drum 2 carrying the sheet rotates in the direction indicated by an arrow, it will be seen that the ink jet head 12 moves in main scanning direction. In response to a signal applied thereto, the head 12 sprays a fine drop of liquid ink against the sheet on the drum surface, thus forming an image to be recorded in the form of a dot matrix pattern.

The sheet which is clamped against the drum 2 may comprise a usual blank paper or any other form of paper.

The purpose of the paper delivery unit 7 is to separate the sheet from the drum surface for delivery after the completion of the printing operation. It comprises a separating roller 16 disposed to be movable toward or away from the drum 2, and a pair of delivery rollers 18 which convey a sheet, as separated from the drum surface, onto a delivery tray 17.

A sheet clamping device which may be used to clamp the sheet against the drum 2 will be described with reference to FIGS. 2 to 7 which illustrate an embodiment of the invention. In these figures, a cylindrical drum 20 has flanges 21 fixed to its opposite ends. A groove 22 is formed in the peripheral surface of the drum 20 and extends in the direction of the generatrix thereof. A central portion 24*a* of a support 24 which carries a sheet seizing claw 23 is received in the groove 22 (see FIGS. 13 and 14).

The sheet seizing claw 23 is formed by a resilient blade such as a leaf spring, and is crosswise curved in substantially the same curvature as the periphery of the drum 40. Along its one end, the claw is formed with a series of stops 24, formed by bending portions of the forward end downwardly or inwardly, and against which the leading end of the sheet is adapted to abut. Along its rear end, the claw 23 is secured to the support 24 by means of the set screws 26.

Adjacent the opposite ends of the groove 22, the drum 20 is formed with notches 27 in which the opposite ends 24*b* of the support 24 are received (see FIGS. 6 and 12 to 14). The opposite ends 24*b* of the support 24 are fixedly mounted, by means of set screws 29, on one end of respective pivot pins 28 which are rotatably mounted on the individual flanges 21 (see FIG. 2). The opposite ends of the pivot pins 28 project externally of the associated flanges 21, and one end of respective levers 30 (only one being shown in FIG. 2) is fixedly mounted on this outer end of the pivot pins 28.

The free end of each lever 30 has one end of a spring 31 anchored thereto, which spring urges the claw 23 away from the surface of the drum, i.e. in a direction to open it. The other end of the spring 31 is secured to a stud 32 fixedly mounted on the outside of the flange 21. It is to be understood that the spring 31 has a resilience of a relatively low magnitude, which is only sufficient to open the claw 23 as illustrated in FIG. 11. The opening of the claw 23 is limited by the abutment of one lateral edge of the lever 30 against a stop 33, as illustrated in FIG. 11.

Figure 32:
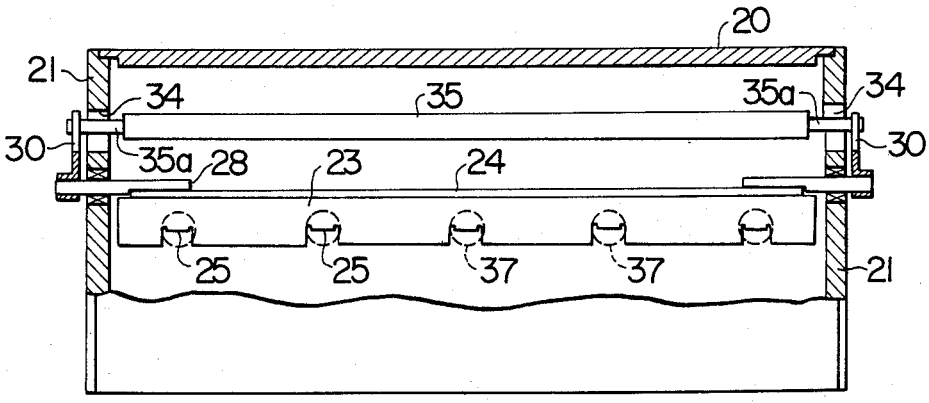
FIG. 32 is a plan view, partly in cross section, illustrating the relative position of the sheet seizing claw and a weight.

The flanges 21 are formed with elongate slots 34 therein (only one being shown in FIGS. 2 and 3), and a weight 35 extends through these slots 34 and through the interior of the drum to have its opposite ends fixedly mounted on the free end of the levers 30 (see FIG. 32). The weight 35 is to be driven away from the center of the drum to urge the claw 23 in a direction to close it, in response to a centrifugal force which is developed during a high speed rotation of the drum 2 as will be further described later.

The periphery of the drum 20 is formed with a row of holes including air suction holes 36, stop advance holes 37 and suction pipe mounting holes 38, the row being disposed parallel to the groove 22. As will be apparent by reference to FIG. 6, the air suction holes 36 and suction pipe mounting holes 38 are located so as to be covered by the sheet seizing claw 23, with the stops 25 formed integrally with the claw 23 advancing into the stop advance holes 37.

Figure 7:
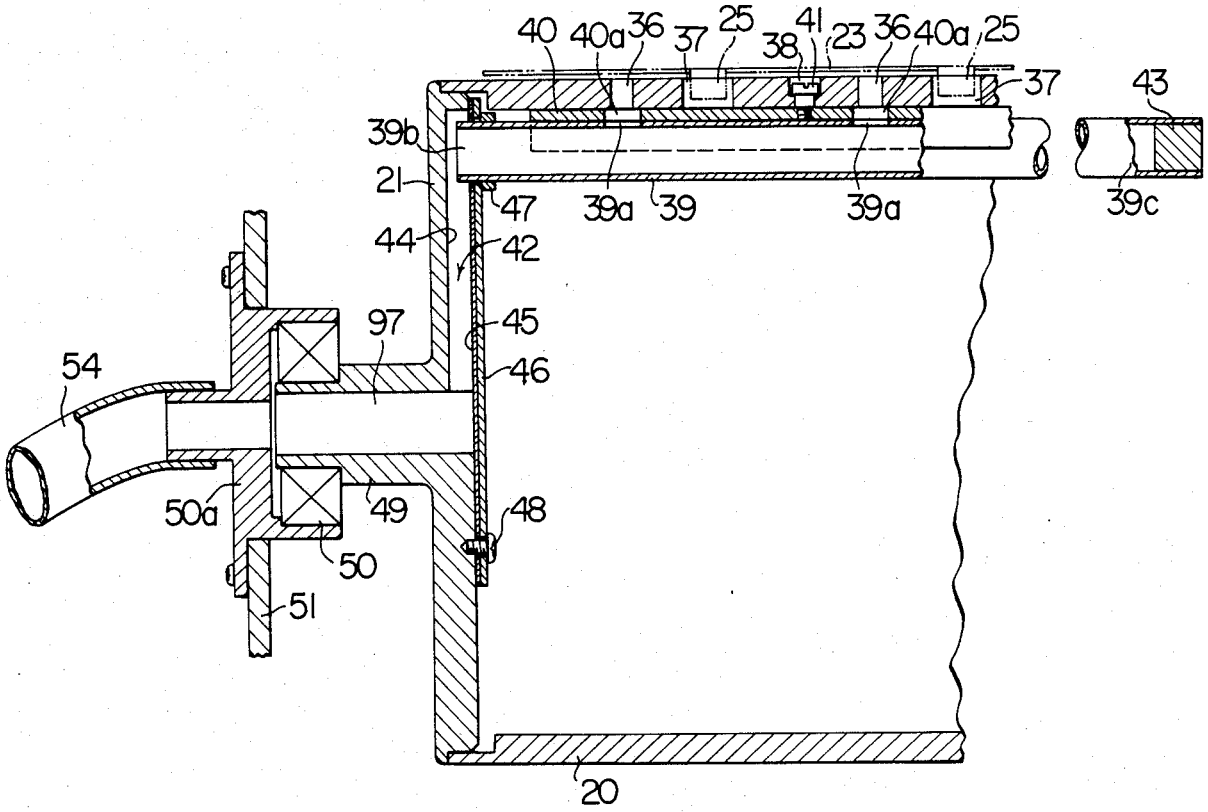
FIG. 7 is a longitudinal section illustrating one form of the interconnection between suction means and sheet suction holes.

Disposed internally of the drum 20 is a suction pipe 39 which extends beneath the row of holes (see FIG. 7). The suction pipe 39 is secured to a pipe holder 40 which is fixedly mounted on the internal peripheral surface of the drum 20 by means of set screws 41 which are disposed in the individual mounting holes 38, as illustrated in FIGS. 7 and 14. Thus, the mounting holes 38 are closed by the screws 41. Also, the stop advance holes 37 are blocked by the pipe holder 40 (see FIG. 13). On the other hand, the air suction holes 36 communicate with the suction pipe 39 through communication holes 40*a*, 39*a* formed in the pipe holder 40 and the suction pipe 39, respectively, as illustrated in FIGS. 7 and 12.

Figure 5:
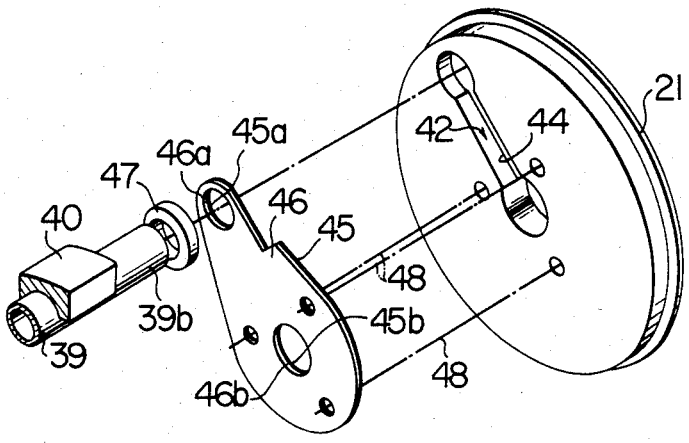
FIG. 5 is an exploded, perspective view of essential parts of an air passage which interconnects suction means with suction holes.
Figure 6:
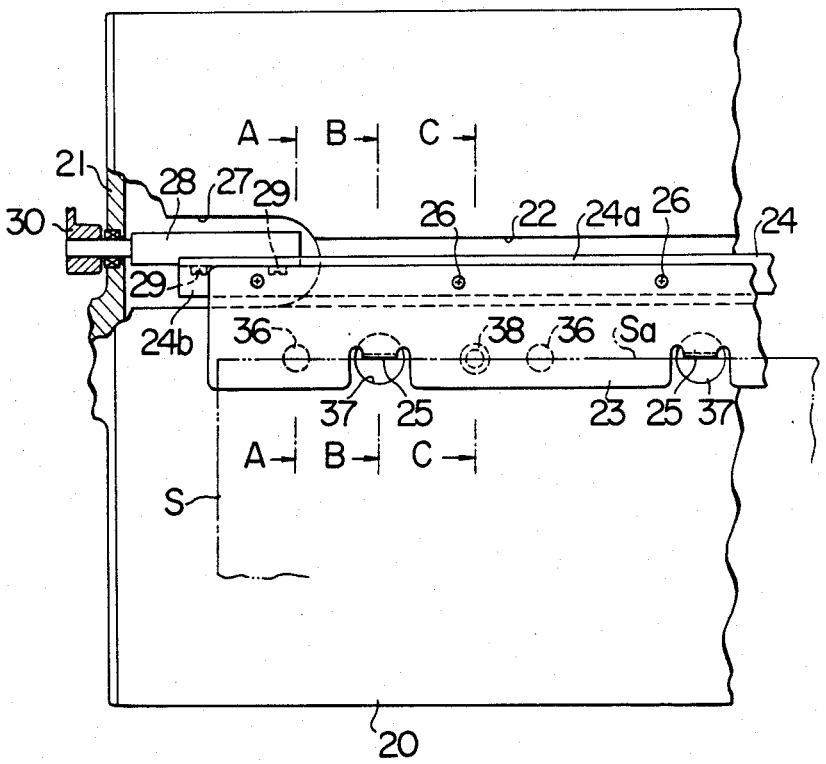
FIG. 6 is a plan view of essential parts shown in FIG. 2.

As illustrated in FIGS. 5 and 7, on end 39*b* of the suction pipe 39 is connected to a first air passage 42 which is formed in one of the flanges 21 while its other end 39*c* is blocked by a plug 43 shown in FIG. 7. It is to be understood that the orientation of the flange is changed in FIG. 5 for the convenience of illustration.

The first air passage 42 is formed by a recess 44 formed in the flange 21, and a rubber gasket 45 and a keeper plate 46 which close the recess 44. The rubber gasket 45 and the plate 46 are formed with openings 45*a*, 46*a* (see FIG. 5), into which the end 39*b* of the suction pipe 39 is fitted, with this end being sealed by a sealing member 47. Both the rubber gasket 45 and the plate 46 are secured to the flange 21 by mounting screws 48. While FIG. 5 shows openings 45*b*, 45*b* formed in the rubber gasket 45 and the keeper plate, the latter openings 45*b*, 46*b* are not provided in an embodiment as shown in FIG. 7 in which a second air passage is provided by utilizing a flange which is hollow in its region adjacent the center of rotation, as illustrated in FIG. 7.

As shown in FIG. 7, one of the flanges 21 is formed with a hollow shaft 49 defining a second air passage 97 which communicates with the first air passage 42. A sealing bearing 50 is fitted over the end of the hollow shaft, and is fixedly supported by a stationary member 51 of the printing machine by utilizing a bearing holder 50*a*.

Consequently, the drum 20 is rotatably mounted through the hollow shaft 49 of the flange 21. The drum 20 is driven for rotation by a gear, not shown, which is fixedly mounted on the hollow shaft 49.

Figure 4:
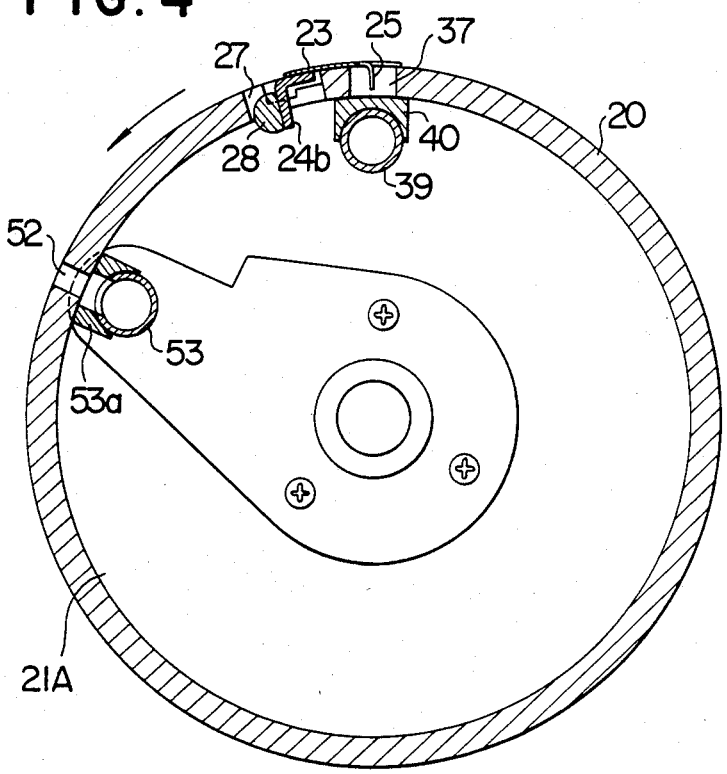
FIG. 4 is a cross section of the device shown in FIG. 2.

What has been describd is a mechanism to clamp the leading end of a sheet (the operation of the mechanism will be described later), and a mechanism to clamp the trailing end of the sheet will now be described. Referring to FIG. 4, the drum 20 is formed with air suction holes 52 at a location advanced from the leading end clamp mechanism, as viewed in the direction of rotation thereof, for attracting the trailing end of the sheet. The suction holes 52 communicate with a suction pipe 53 through pipe holders 53*a*, the suction pipe 53 being arranged in the same as the suction pipe 39 mentioned above. It is to be understood that the suction pipe 53 is connected to an air passage, not shown, formed in the other flange 21.

Figure 2:
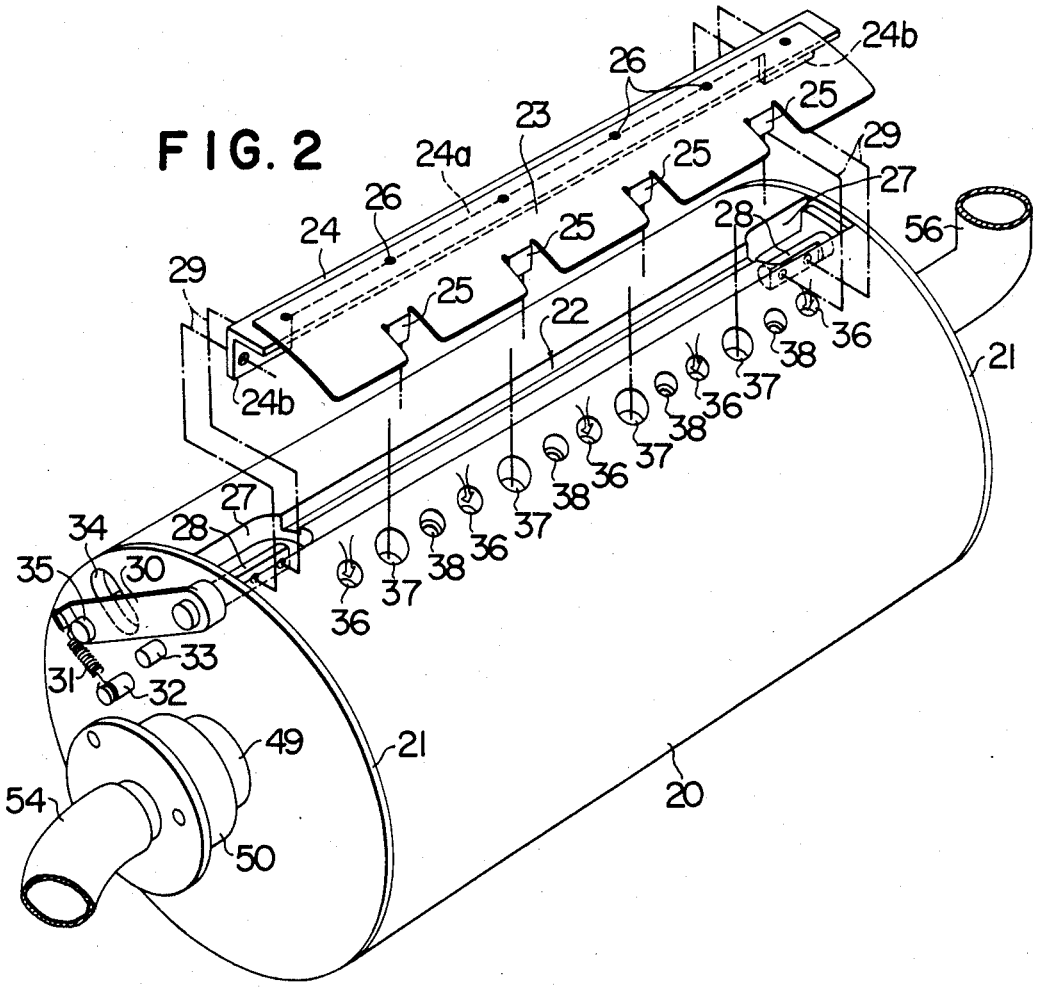
FIG. 2 is a perspective view of one embodiment of the invention.
Figure 3:
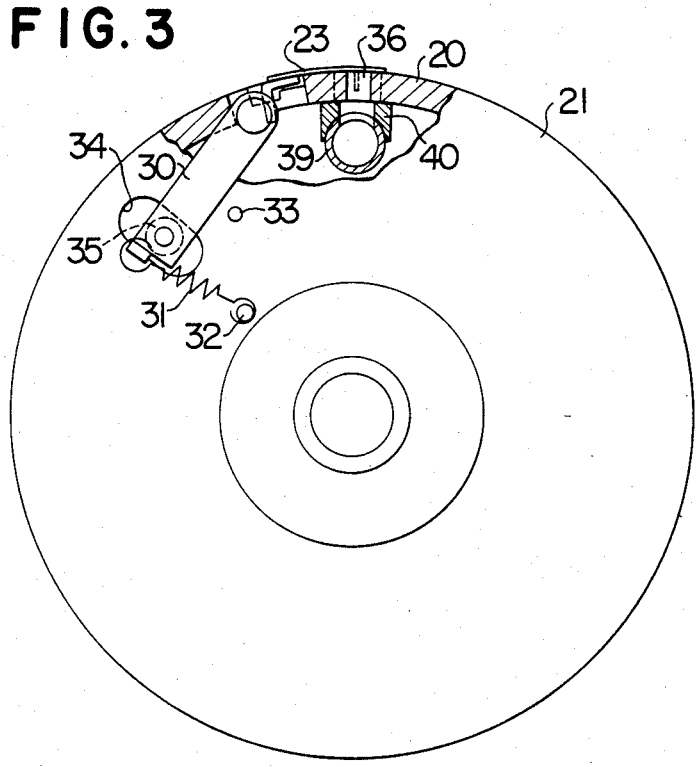
FIG. 3 is a left-hand side elevation of the device shown in FIG. 2.
Figure 19:
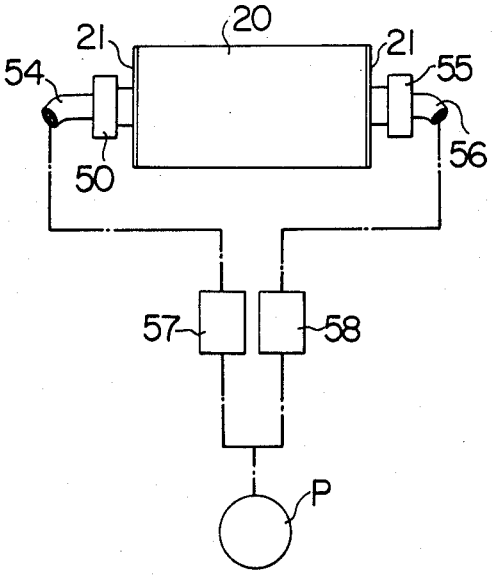
FIG. 19 is a diagram illustrating one form of an air flow path between the drum and suction means.

Referring to FIGS. 2 and 19, the bearing 50 which communicates with the suction holes 36 attracting the leading end of the sheet is connected to one end of a vacuum hose 54 while a bearing 55 (only shown in FIG. 19) which communicates with the suction holes 52 attracting the trailing end of the sheet is connected to one end of another vacuum hose 56. The other end of the vacuum hoses 54, 56 are connected to a single vacuum pump P as illustrated in FIG. 19 in the present embodiment, with solenoid valves 57, 58 being disposed in the respective hoses, to open or close the air passages. The timing to operate these solenoid valves will be described later.

Figure 23:
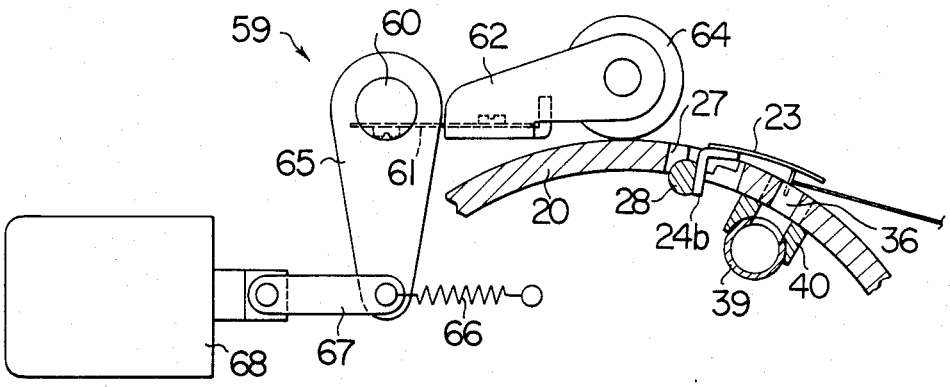
FIG. 23 is a cross section of one form of a hold down device.
Figure 24:
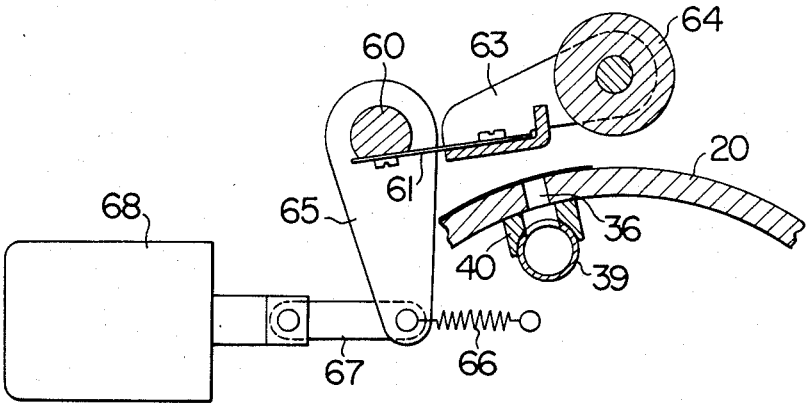
FIG. 24 is another cross section of the hold down device.

Referring to FIGS. 23 and 24, there is shown a device 59 arranged adjacent the drum 20 for holding the sheets to the drum. The device 59 comprises a shaft 60 rotatably mounted by a stationary member, not shown, a pair of roller support arms 62, 63 mounted on the shaft 60 through a leaf spring 61, a roller 64 rotatably supported by the support arms 62, 63 and having substantially the same length as the drum 20, a lever 65 having its one end fixedly mounted on the shaft 60, a spring 66 having its one end secured to the free end of the lever 65 and urging the roller 64 to its position away from the drum 20 as shown in FIG. 24, and a solenoid 68 connected to the free end of the lever 65 through a link 67.

The resilience of the spring 66 normally maintains the roller 64 at a position removed from the drum surface, as shown in FIG. 24, but the roller 64 may be brought into abutment against the drum surface, as shown in FIG. 23, when the solenoid 68 is energized during a sheet clamping operation as will be further described later.

Figure 21:
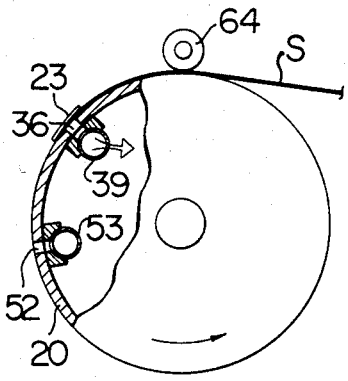
Figure 22:
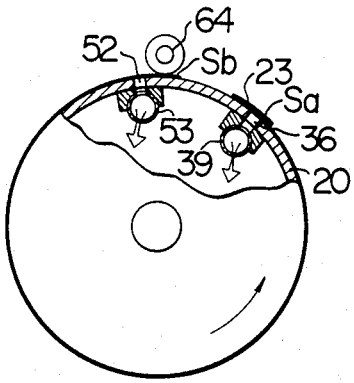

The sheet clamping operation of the described arrangement will now be described with reference to FIGS. 20 to 22. During a sheet clamping operation, it may be assumed that the drum 20 is rotating at a low speed of 30 rpm, for example. Before the leading end of the sheet is fed into the clearance between the claw 23 and the drum 20, both solenoid valves 57, 58 are maintained closed. Since no suction of air takes place through the suction holes 36, the claw 23 is rocked to its open position under the resilience of the spring 31, as illustrated in FIG. 11. Under this condition, the stops 25 partly move into the stop advance holes 37.

Figure 20:
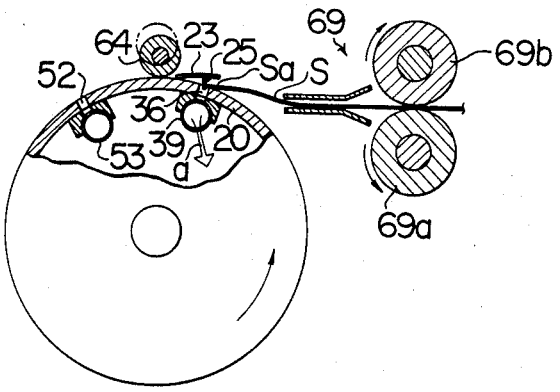
FIGS. 20 to 22 are side elevations, partly cut away, illustrating a sheet clamping operation.

When the drum 20 rotates to its position illustrated in FIG. 20 with the claw maintained in its open position, a pair of sheet delivery rollers 69, corresponding to the rollers 9, 10 shown in FIG. 1, rotate in synchronized relationship therewith, thus delivering the sheet S held therebetween toward the drum surface. The pair of delivery rollers 69 are designed to feed the sheet S with a speed slightly greater than the peripheral speed of the drum 20, whereby the leading edge Sa of the sheet S abuts against the stops 25 formed on the claw 23 (see FIG. 6). Considering the sheet feeding action by the roller pair 69 more specifically, one of the rollers of the pair, 69*a*, is provided with a clutch, not shown, which operates to initiate the rotation of the roller 69*a* in timed relationship with the rotation of the claw on the drum 20. The other roller or idle roller 69*b* rotates in following relationship therewith. The clutch remains activated to continue the feeding operation until the leading end of the sheet is held underneath the sheet seizing claw, attracted to the drum surface and extends below the roller 64. As a result, a flexure (see FIG. 20) is formed in the sheet which has its leading end disposed against the claw as a result of a difference between the linear speed of the drum and the linear speed of the sheet being fed. When the leading end of the sheet reaches the location of the claw 23 or the roller 64, the clutch mentioned above is turned off, whereby the roller 69*a* is no longer driven. Subsequently, the pair of rollers 69 only follow the movement of the sheet which is pulled by the drum with its leading end clamped, and held against the drum surface by means of the roller 64.

When the solenoid valve 67 (see FIG. 19) is energized at a suitable time interval after the initiation of the rotation of the roller pair 69, the air is withdrawn in a direction indicated by an arrow a in FIG. 20 through the suction holes 36, and through a path including the vaccum hose 54, bearing 50, the second air passage 97, the first air passage 42 and the suction pipe 39 (see FIG. 7).

In response to the suction of the air through the suction holes 36, an area of the sheet S which is located to block substantially one half of the opening of the holes 36 is initially attracted to the holes, followed by a movement of the sheet seizing claw 23 toward the remainder of the opening the suction holes 36. As mentioned previously, the resilience of the spring 31 (see FIG. 11) which urges the claw to its open position has a reduced magnitude, and hence the claw 23 can be readily attracted to the drum surface by the air suction through the suction holes 36.

During the sheet clamping operation, the roller 64 is maintained in abutment against the drum surface 20 as shown in solid line in FIG. 20, whereby the claw 23 having the leading end of the sheet clamped between it and the drum is positively held against the drum surface. When the drum 20 rotates to the position shown in FIG. 21 while continuing to clamp the leading end of the sheet S, the roller 64 rolls over the sheet S so that the entire length of the sheet is smoothly placed in close contact with the drum surface. When the trailing end Sb of the sheet S comes to block the suction holes 52 as indicated in FIG. 22, the solenoid valve 58 (FIG. 19) is energized to cause a suction of the air through the suction holes 52, thus attracting the trailing end of the sheet. In this manner, the sheet has its leading end clamped by the claw 23 and the suction holes 36 and has its trailing end clamped by the suction through the suction holes 52. As mentioned previously, the sheet S is disposed in close contact with the drum surface by the action of the roller 64.

When the sheet clamping operation is completed, the drum 20 is then rotated with a greater speed of 1,000 rpm, for example, thus initiating a printing of the sheet by the recorder 6 (FIG. 1).

Upon completion of the printing operation when the area of the drum surface clamping the leading end of the sheet moves close to the paper delivery unit 7 (FIG. 1), the solenoid valve 57 (FIG. 19) is deenergized, interrupting the air suction through the suction holes 36. Hence, the claw 23 rocks under the resilience of the spring 31 (FIG. 11), releasing the sheet clamping action. Subsequently at the same time, the separating roller 16 (FIG. 1) is brought into abutment against the sheet on the drum, instantaneously extracting the sheet from underneath the claw 23 and feeding it toward the delivery rollers 18. Subsequently, the roller 16 rotates in following relationship with the rotation of the drum 20 with the sheet interposed therebetween.

It is unnecessary to release the clamping action associated with the trailing end of the sheet if the separated leading end is held between the delivery rollers 18. However, the solenoid valve 58 is preferably deenergized to interrupt the air suction through the suction holes 52 when an area of the drum 20 clamping the trailing end reaches the paper delivery unit. In this manner, it can be avoided that the trailing end of the sheet may move away from the drum surface to strike other parts, for example, an ink jet head, thereby preventing any damage to the sheet. In the embodiment described above, the suction holes 36 formed in the drum 20 and the suction means or vacuum pump P are interconnected through the air passage 97 defined inside the hollow shaft 49 which is mounted on the flange 21, and the hollow shaft is also utilized as the drive shaft for the drum. However, other forms of interconnecting the drum and the suction means as well as other forms of a drum drive mechanism may be used and will now be described. In the description to follow, it is to be understood that corresponding parts to those described above are designated by like reference characters.

Referring to FIG. 15, the drum 20 may include a pair of flanges 70, 71, which are utilized to fixedly mount the drum on a drum support shaft 72, which is rotatably mounted by stationary side plates 73, 74 of a printing machine through bearings 75, 76.

Figure 8:
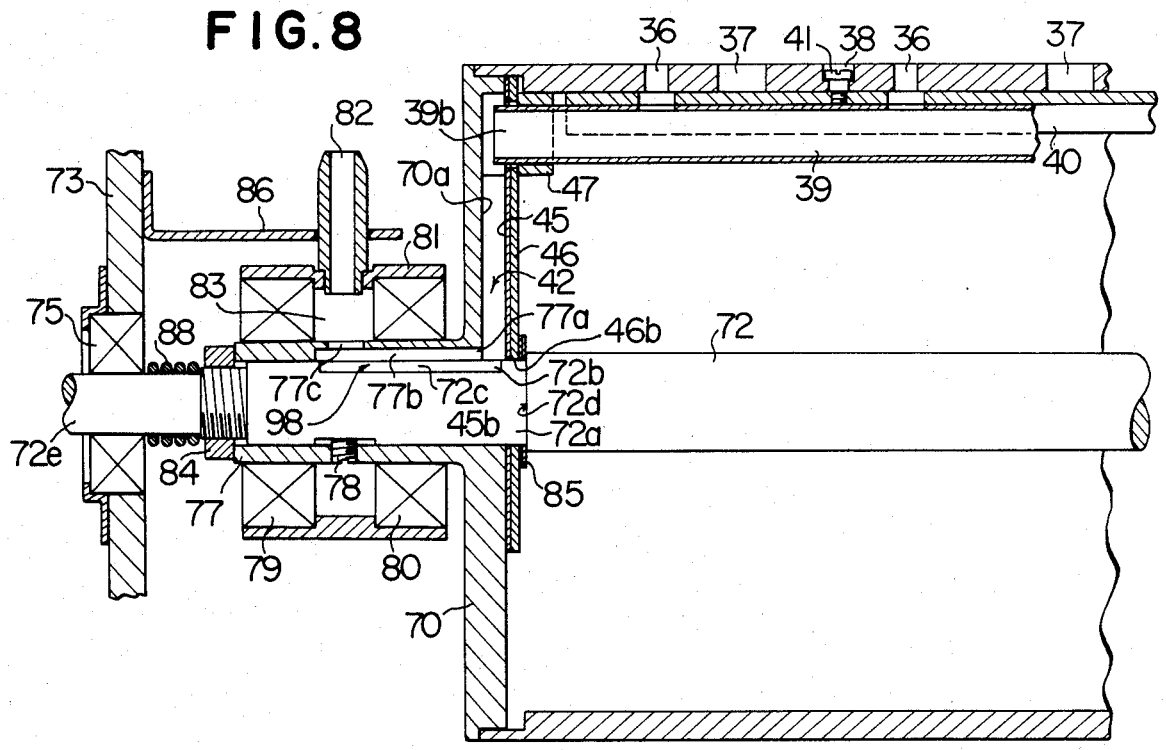
FIG. 8 is a longitudinal section illustrating another form of the interconnection between suction means and sheet suction holes.

As shown in FIG. 8, one of the flanges, 70, is formed with a first air passage 42 comprising a recess 70*a*, a rubber gasket 45 and a keeper plate 46 in the similar manner as illustrated in FIG. 5. In the embodiment being described, both the rubber gasket 45 and the keep plate 46 are formed with openings 45*b*, 46*b* into which the drum support shaft 72 is fitted, as illustrated in FIG. 5.

The flange 70 includes a hollow shaft 77, which is fitted over a first stepped portion 72*a* of the support shaft 72, and is secured thereto in substantially integral manner by a locking screw 78. The first portion 72*a* of the support shaft is formed with an axially extending groove 72*c* having its one end 72*b* located in the region of a first air passage 42. The inner peripheral surface of the hollow shaft 77 is formed with an axially extending groove 77*b* which has its one end 77*a* communicating with the first air passage 42. The grooves 72*c* and 77*b* are located opposite each other, thus defining a second air passage 98. The other end of the groove 77*b* is formed with an opening 77*c* which provides a communication between the interior and the exterior of the hollow shaft 77.

Figure 25:
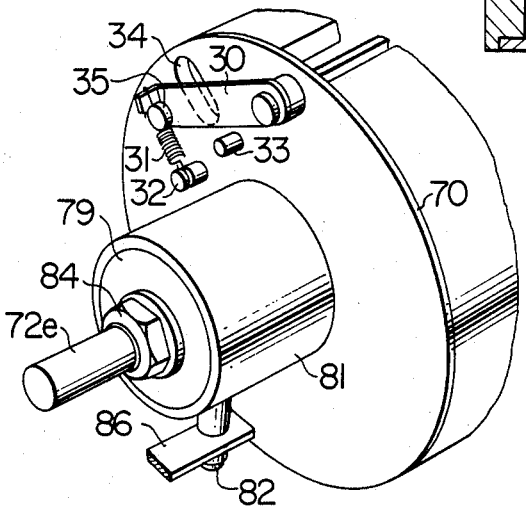
FIG. 25 is a perspective view showing essential parts of the arrangement shown in FIG. 8.

A pair of bearings 79, 80 are fitted over the hollow shaft 77 on the opposite sides of the opening 77*c*, these bearings being carried by a bearing housing 81 (see FIG. 25) having a nipple construction 82. These bearings are of a sealing type, and define an annular space 83 between them, the housing 81 and the hollow shaft 77.

The connection 82 is connected to the vacuum pump P through a vacuum hose, not shown, and the solenoid valve 57 (FIG. 19). Consequently, the suction holes 36 formed in the drum 20 are connected to the vacuum pump P (FIG. 19) through the suction pipe 39, first air passage 42, second air passage 98, annular space 83 and connection 82.

The first stepped portion 72*a* of the drum support shaft 72 has its one end threaded, which is engaged by a nut 84, whereby the flange 70 is urged to the right, as viewed in FIG. 8. The nut 84 urges a sealing member 85, located between the keeper plate 46 and the stepped portion 72*d* of the support shaft, against the step 72*d*, whereby the air tightness between the first air passage 42 and the support shaft 72 is maintained. Consequently, the screw 78 is tightened after the nut 84 has been tightened. The bearings 79, 80 are locked against rotation by means of an anti-rotating element 86 which holds the connection 82. It should also be noted that the suction holes 52 which are used to attract the trailing end of the sheet are similarly connected to the vacuum pump P.

Figure 26:
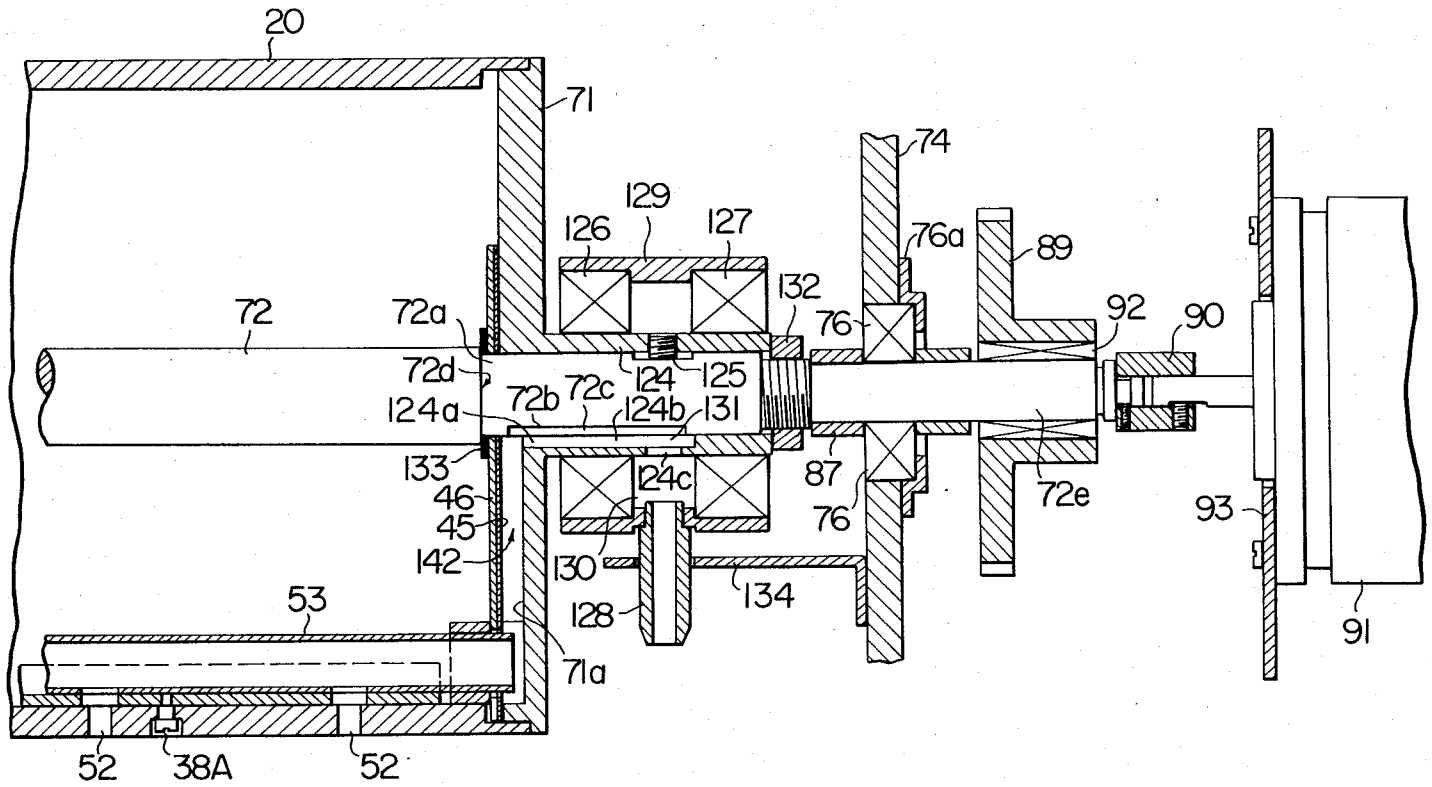
FIG. 26 is an enlarged cross section of essential parts shown in FIG. 15.

A first air passage 142 is also formed in the other flange 71, and comprises a recess 71*a*, rubber gasket 45 and keeper plate 46, as shown in FIG. 26. In the embodiment being described, the rubber gasket 45 and the keeper plate 46 are formed with the openings 45*b*, 46*b* in which the first stepped portion of the drum support shaft 72 is fitted.

The flange 71 is provided with a hollow shaft 124 which is fitted over a first stepped portion 72*a* of the drum shaft 72, and is secured in substantially integral manner thereto by means of a locking screw 125. The first stepped portion 72*a* of the support shaft is formed with an axially extending groove 72*c* having one end 72*b* which reaches the region of the air passage 142. On the other hand, the inner surface of the hollow shaft 124 is formed with an axially extending groove 124*b* having one end 124*a* which communicates with the air passage 142. It is to be understood that the grooves 72*c* and 124*b* are aligned, defining a second air passage 131. The other end of the groove 124*b* is formed with an opening 124*c* which provides a communication between the interior and exterior of the hollow shaft 124.

A pair of bearings 126, 127 are fitted over the hollow shaft 124 on the opposite side of the opening 124*c*, these bearings being carried by a bearing housing 129 having a connection 128. The bearings 126, 127 are of a sealing type, and define an annular space between these bearings, the housing 129 and the hollow shaft 124.

Figure 17:
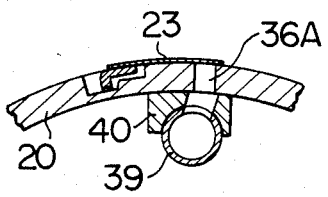
FIG. 17 is a cross section taken along the line D—D shown in FIG. 16

The connection 128 is connected to the vacuum pump P through a vacuum hose, not shown, and the solenoid valve 58 (see FIG. 17). Consequently, the suction holes 52 formed in the drum 20 for attracting the trailing end of the sheet are connected to the vacuum pump P (FIG. 19) through the suction pipe 53, the first air passage 142, the second air passage 131, the annular space 130 and the connection 128.

The end of the first stepped portion 72*a* of the drum support shaft 72 is threaded and is threadably engaged by a nut 132, which urges the flange 71 to the left, as viewed in FIG. 26. The nut 132 urges a sealing member 133 located between the keeper plate 46 and the step 72 against the latter, whereby the air tightness between the air passage 142 and the support shaft 72 is maintained. Consequently, the screw 125 is tightened after the nut 132 has been tightened. The bearings 126, 127 are located against rotation by anti-locking element 134 which locks the connection 128.

In FIG. 15, the drum 20 is urged to the right by a compression spring 88 disposed on a left-hand second stepped portion 72*e* of the support shaft 72, whereby a spacer 87 fitted over a right-hand, second stepped portion 72*a* is brought into abutment against the bearing 76. A gear 89 is mounted on the right-hand end of the support shaft 72 with a one-way clutch 92 interposed therebetween, and the axial end is connected to an encoder 91 through a joint 90.

The purpose of the gear 89 is to drive the drum for rotation at a relatively low speed, for example, 30 rpm, during the time when a sheet is to be disposed against the drum surface. The gear is connected to a drive source, not shown, of the printing machine. The rotation of the gear 89 is transmitted to the support shaft 72 through the one-way clutch 92, while preventing the transmission of rotation of the support shaft 72 to the gear 89.

The encoder 91 is mounted on a support plate 93, and controls the timing of the operation of the solenoid valves 57, 58 and other devices operating during the rotation of the drum, as the support shaft 72 rotates.

In FIG. 15, a drum drive motor 95 is connected to the left-hand end of the support shaft 72 through a coupling 94. The purpose of the motor 95 is to drive the drum 20 for rotation at a relatively high speed, for example, 1,000 rpm, during a printing opration. The motor is substantially directly coupled to the drum, and is mounted on a support plate 96 which is fixedly mounted on the side plate 73.

As shown in FIG. 15, when a suction pipe is disposed on the internal surface of the drum and is disposed in communication with the first air passage, defined by a partial recess formed in the flange and communicating with a second air passage which is defined in the hollow portion in alignment with the center of rotation and which is connected to a vacuum pump to thereby enable an air suction, it is possible to directly couple a drive motor and an encoder with the drum support shaft, enabling a drum drive and a signal generation with a high accuracy.

In the arrangement shown in FIG. 15, the drum 20 is driven for rotation at a low speed by means of the gear 89 during a sheet clamping operation while it is driven for rotation at a higher speed by means of the motor 95 during a subsequent printing operation. The air suction through the suction holes 36, 52 to clamp the leading and the trailing end of the sheet is controlled by the timed operation of the solenoid valves 57, 58 in response to a signal from the encoder 91. It is to be understood that the timing of operating the suction holes 36, 52 remains the same as mentioned in connection with the first embodiment.

Figure 9:
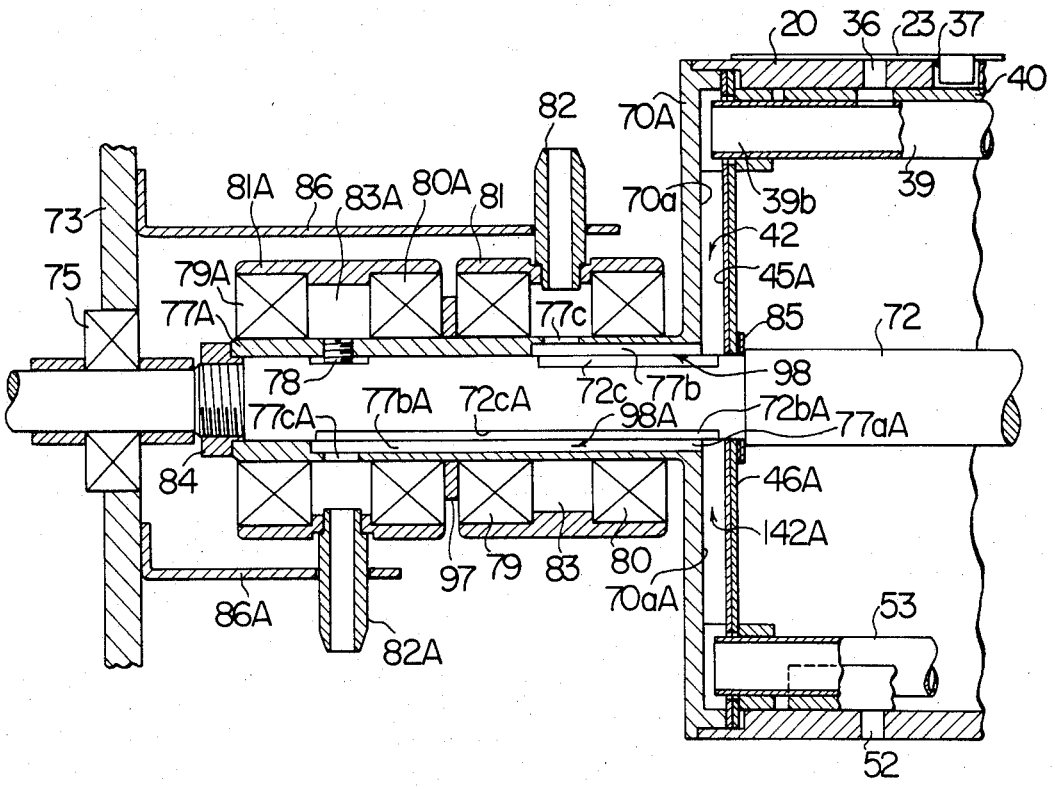
FIG. 9 is a longitudinal section of a further form of the interconnection.
Figure 10:
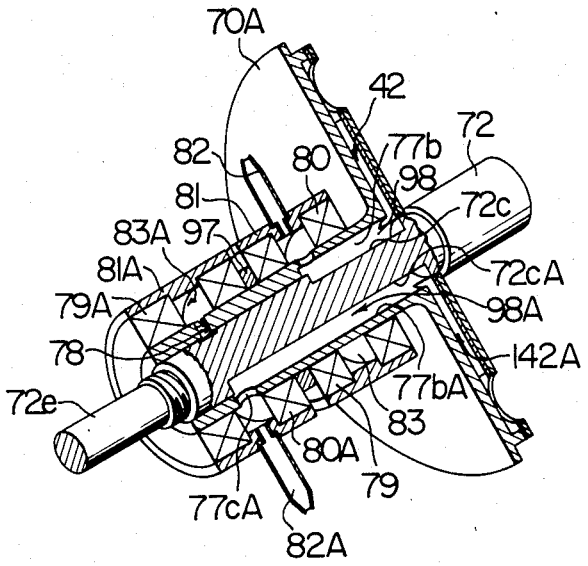
FIG. 10 is a perspective view, partly in cross section, of parts of the arrangement shown in FIG. 9.

In the embodiment shown in FIG. 15, means for connecting the suction holes 36, 52, which attract the leading and the trailing end of the sheet, to the exterior is provided at the opposite ends of the drum, but such means may be provided on only one end of the drum. Referring to FIGS. 9 and 10, a flange 70A having a hollow shaft 77A having a greater length than the hollow shaft 77 shown in FIG. 8 is clamped to the drum support shaft 72 by a nut 84, and is also secured thereto in an integral manner by a screw 78. First and second air passages 42, 98 communicating with the suction holes 36 which attract the leading end of a sheet remain the same as those shown in FIG. 8, and hence will not be described. The air passage communicating with the suction holes 52 which attract the trailing end of the sheet will now be described.

The flange 70A is formed with a recess **70*a* forming a part of the first air passage 42, and is also formed with another recess 70*a*A forming a part of another air passage 142A. These two recesses are hermetically covered by respective gaskets 45A and keeper plates 46A**.

A pair of bearings 80A, 79A are disposed on the hollow shaft 77A with a spacer 97 interposed between the bearing 80A and the bearing 79. The bearings 80A, 79A are both of a sealing type and are carried by a bearing housing 81A to define an annular space 83A therebetween. A connection 82A has its one end opening into the annular space 83A, and is kept against rotation by an anti-rotation element 86A.

The internal surface of the hollow shaft 77A is formed with a groove **77*b*A having its one end 77*a*A located in the air passage 142A and having an opening 77*c*A formed in its other end which communicates with the annular space 83A. A groove 72*c*A is formed in the support shaft 72 in opposing relationship with the groove 77*b*A and having its one end 72*b*A located in the air passage 142A. The grooves 77*b*A and 72*c*A define another air passage 98A. The connection 82 is connected to the vacuum pump by the solenoid valve 57 (FIG. 19) which virtually controls the clamping operation of the leading end of a sheet while the connection 82A is connected to the vacuum pump by the solenoid valve 58**.

As the drum 20 rotates, the flange 70A and the support shaft 72 rotate in an integral manner maintaining the openings **77*c*, 77*c*A communicating with the suction holes 36, 52, respectively, in communication with the annular spaces 83, 83A**.

When the hermetic connection means between the rotatable and non-rotatable portion is disposed on one end of the drum in an assembled manner as shown in FIG. 9, the disposition of the vacuum hose leading to the vacuum pump P (see FIG. 19) is facilitated, presenting an advantage in design requiring less span.

In FIG. 9, the suction holes 36, 52 are disposed at a phase differential of 180° circumferentially of the drum 20 with their communicating air passage disposed in a corresponding manner. However, it should be understood that this is for purpose of illustration only, but that the location of these holes are selected so as to achieve alignment with the leading and the trailing end of the sheet being disposed around the drum as required by a length thereof as indicated in FIG. 4.

It has been mentioned previously that a feature of the invention is the attraction of the sheet against the drum surface by a timed application of suction through the plurality of suction holes formed in the drum in order to withdraw the external air. The relative position of the suction holes, the sheet seizing claw and the sheet has been illustrated in FIG. 6 as an example when it will be noted that the suction holes 36 alone are capable of attracting both the sheet and the sheet seizing claw.

Figure 16:
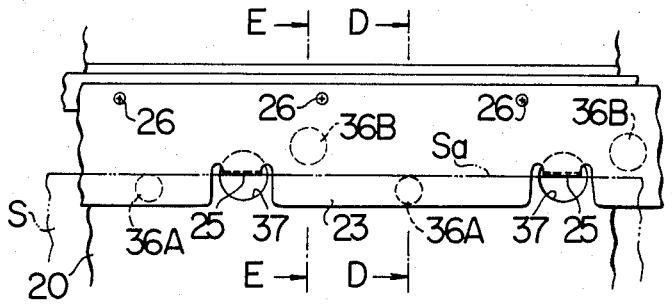
FIG. 16 is a plan view of essential parts of another embodiment of the invention.
Figure 18:
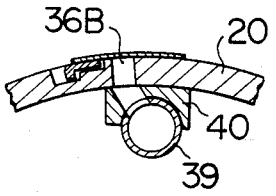
FIG. 18 is a cross section taken along the line E—E shown in FIG. 16.

Referring to FIGS. 16 to 18, an arrangement will be described in which suction holes for attracting the sheet and the sheet seizing claw are separately provided. An area of the drum 20 which is adapted to be engaged by the sheet seizing claw 23 is formed with sheet suction holes 36A for attracting the sheet when the leading edge Sa thereof is brought into abutment against the stop 25, and is also formed with claw suction holes 36B for attracting the sheet seizing claw 23. As shown in FIGS. 17 and 18, both of the suction holes 36A, 36B communicate with the suction pipe 39.

When the claw 23 is open (see FIG. 11), the sheet S is fed into the clearance between the claw and the drum until its leading end Sa is brought into abutment against the stop 25. Thereafter, suction from the vacuum pump P (FIG. 19) is applied through the suction pipe 39, whereupon the air is withdrawn through both suction holes 36A, 36B. Since the claw 23 is resiliently urged (refer to spring 31 shown in FIG. 11) to its open position, the leading end of the sheet S which is located closer to the suction holes 36A than the sheet seizing claw are attracted by these suction holes while it remains free. When the suction holes 36A are blocked by the sheet, the amount of air suction through the other suction holes 36B substantially increases, whereby the claw 23 is attracted to them against the resilience of the spring mentioned above.

In the embodiment shown in FIG. 16, the suction holes attracting the sheet and the suction holes attracting the claw are provided separately, affording an advantage that a more reliable clamping of the leading end of the sheet is achieved. It is to be understood that holes (corresponding to 38 shown in FIG. 6) in which the suction pipe is mounted are not shown in FIG. 16.

In the above description, the suction means which is used to attract the leading and the trailing end of the sheet comprises a single vacuum pipe P and a pair of solenoid valves 57, 58, as an example. However, it should be understood that a firat pump for attracting the leading end of the sheet and a second pump for attracting the trailing end of the sheet may be separately provided. In addition, means for controlling the timing of application of the air suction is not limited to the encoder 91 mentioned above, but alternatively, the solenoid valves 57, 58 may be operated by means of a timer unit which is in itself well known in the art. As a further alternative, the vacuum pump may be directly operated.

In the embodiment mentioned above, the drum 20 is substantially integrally connected with the drum shaft 72 through the flanges 70, 71. This construction is advantageous to prevent an eccentricity of the peripheral surface of the drum. However, the drum shaft may be integrally formed with the flanges in accordance with the invention.

Figure 27:
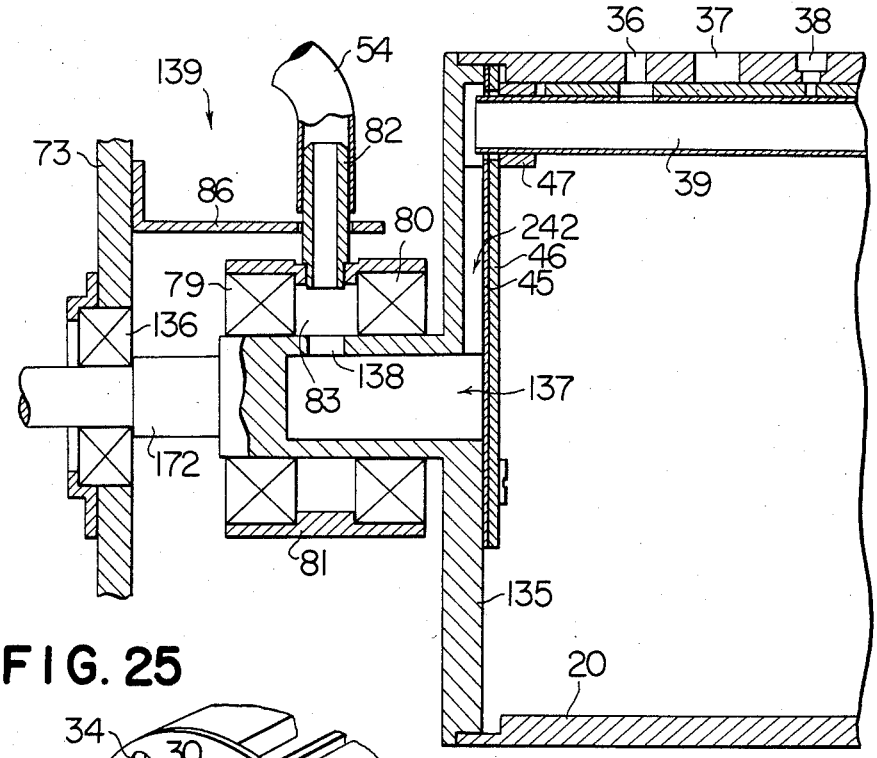
FIG. 27 is a longitudinal section illustrating still another form of interconnection between suction means and sheet suction holes.

Such an arrangement will now be described with reference to FIG. 27. In FIG. 27, a flange 135 is integrally formed with a drum shaft 172 which has its one end supported by a bearing 136. The shaft 172 is hollow and is formed with a second air passage 137, one end of which opens into the peripheral surface through an opening 138. The other end of the passage 137 communicates with one end of a first air passage 242, which is formed in the similar manner as the first air passage 42 mentioned above. The other end of the first air passage 242 is connected to one end of the suction pipe 39.

Connection means 139 is mounted on the shaft 172 in surrounding relationship with the opening 138. The connection means 139 is constructed in the same way as illustrated in FIG. 8, and hence its components will be designated by like reference characters. What is shown in FIG. 27 is an arrangement for applying a suction to the suction holes 36 which attract the leading end of the sheet, but the other flange may be similarly constructed where the attraction of the trailing end of the sheet is also desired. In an arrangement as shown in FIG. 27, it is also possible to directly couple a drive motor to the drum shaft, thus providing the same advantage as mentioned above.

As discussed, by providing a plurality of suction holes including those used to attract the leading end of a sheet and those attracting the trailing end of a sheet, and by applying a suction to these holes or groups of holes at different times so that the air suction intially takes only through those suction holes which attract the leading end of the sheet and subsequently applying the air suction to the remaining suction holes which attract the trailing end of the sheet when the latter end has reached the regions of these suction holes, the use of a vacuum pump of a reduced capacity and hence a reduced size is possible, permitting a reduction in the size of the overall arrangement and also reducing noise. The separate provision of the suction holes for separate attraction of the leading and the trailing end of the sheet increases the air suction exerted through the respective suction holes, whereby such suction can be utilized to close the sheet seizing claw, thus minimizing parts which are required to operate or close the claw in a mechanical manner. In this manner, there is provided a sheet clamping device which is simple in construction and reliable in operation.

While several specific embodiments of the invention have been described above, it should be understood that the invention is not limited thereto but that a number of changes and modifications will readily occur to those skilled in the art without departing from the spirit of the invention.

By way of example, in the embodiment shown, rather than disposing the suction holes attracting the leading and the trailing end of a sheet each in a row along the generatrix of the drum, they may be disposed in a plurality of rows. In addition, another row of suction holes may be provided to attract the central portion of the sheet.

Figure 29:
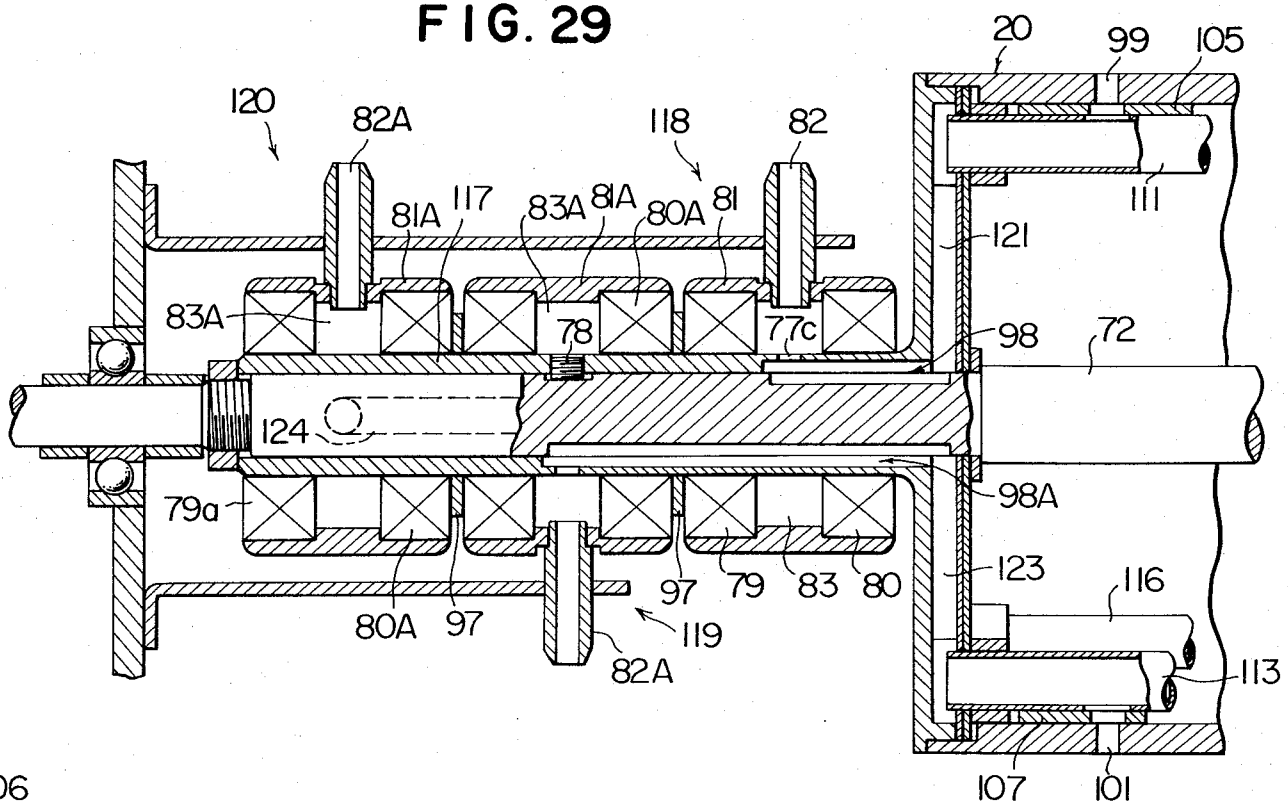
FIG. 29 is a cross section, illustrating one axial end of the drum of FIG. 28 to an enlarged scale.
Figure 28:
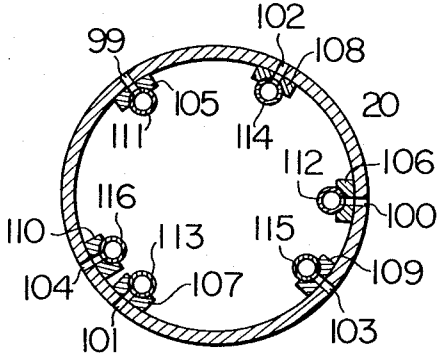
FIG. 28 is a cross section of a drum having sheet suction holes formed therein in accordance with the sheet size.
Figure 30:
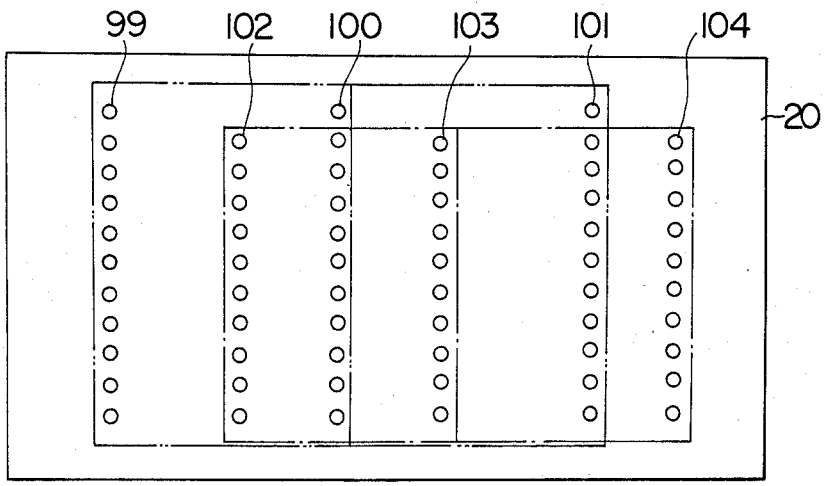
FIG. 30 is a developed view of the peripheral surface of the drum shown in FIG. 28.

FIGS. 28 to 30 show a further embodiment of the invention. Specifically, FIG. 29 is a longitudinal section of a sheet clamping device, FIG. 28 is a cross section showing one axial end of the drum and FIG. 30 is a developed view of the drum surface. In this embodiment, the drum 20 is formed with six rows of sheet suction holes. Suction holes 99, 100, 101 in the first, third and fifth row are distributed in an area having a width corresponding to that of an international A3-size sheet. The first row of suction holes 99 is adapted to attract the leading end of a sheet of A3 and A4-sizes while the third row of suction holes 100 is adapted to attract the trailing end of a sheet of A4-size. The fifth row of suction holes 101 is adapted to attract the trailing end of a sheet of A3-size. The rows of suction holes 102, 103, 104 are distributed in an area having a width dimension corresponding to sheets of B4-size. The row of suction holes 102 is located intermediate the first and the third row of suction holes to attract the leading end of sheets of B4- and B5 sizes, and the row of suction holes 103 is adapted to attract the trailing end of a sheet of B5-size while the row of suction holes 104 is adapted to attract the trailing end of a sheet of B4-size.

The first to the sixth row of suction holes are individually supplied with a negative pressure through suction pipes 111 to 116, mounted on the inner surface of the drum 20 by means of holders 105 to 110, respectively, and through openings formed in these holders. As shown in FIG. 29, the negative pressure is supplied to the suction pipes 111, 113, 116 independently through joints 118, 119, 120, which are rotatably mounted on the hollow shaft 117 on one end of the drum 20, and through air passages 121 to 123, respectively, which are formed to extend through the hollow shaft 117, support shaft 72 and the end of the drum 20. The construction of the rotatable joints 118, 119, 120 is similar to that shown in FIG. 9, and hence corresponding parts are designated by like reference characters without repeating their description. As is evident, they are connected to a pump, acting as a source of negative pressure, through respective vacuum hoses, not shown. However, it is to be noted that a negative pressure controller (equivalent to those shown at 57, 58 in FIG. 19) is disposed intermediate the individual rotatable joints 118 to 120 and the source of negative pressure so that the negative pressure is supplied to a selected one of the rotatable joints. Suction pipes 112, 114, 115 are not shown, but are located on the opposite end of the drum 20 and are constructed in the similar manner as shown in FIG. 29 so that the negative pressure can be selectively supplied thereto.

When a sheet of A3-size is to be held against the drum surface, the negative pressure is supplied to only the first and the fifth row of suction holes 99, 101 with the first row of suction holes 99 attracting the leading end and the fifth row of suction holes 101 attracting the trailing end of the sheet each against the drum surface.

When a sheet of A4-size is to be held against the drum surface, the negative pressure is supplied to the first and the third row of suction holes 99, 100. The first row of suction holes 99 attracts the leading end while the third row of suction holes 100 attracts the trailing end of the sheet, each against the drum surface. Thus, the first row of suction holes are used in common when holding sheets of A3- and A4 sizes against the drum surface.

When holding a sheet of B5-size against the drum surface, the negative pressure is supplied to the second and the fourth row of suction holes 102, 103. The second row of suction holes 102 attracts the leading end while the fourth row of suction holes 103 attracts the trailing end of the sheet, each against the drum surface.

When a sheet of B4-size is to be held against the drum surface, the negative pressure is supplied to the second and the sixth row of suction holes 102, 104. The second row of suction holes 102 attracts the leading end while the sixth row of suction holes 104 attracts the trailing end of the sheet, each against the drum surface. Thus, the second row of suction holes 102 are used in common when holding sheets of B5- and B4-size against the drum surface.

It will be noted that the location of the leading end of a sheet will be displaced by an amount corresponding to a circumferential distance around the drum periphery between the first row and the fourth row of suction holes 99, 102 between when a sheet of A4- and A3-size is held and when a sheet of B5- and B4-size is holed. Consequently, it is necessary that the timing when the rotation of a register roller which defines the paper feed position for the drum be changed depending upon the sheet size. Specifically, with the described arrangement, the sheet delivery to the drum can be performed by lagging the timing of initiating the rotation of the register roller when feeding a sheet of B5- or B4-size as compared with when feeding a sheet of A4- or A3-size.

Figure 31:
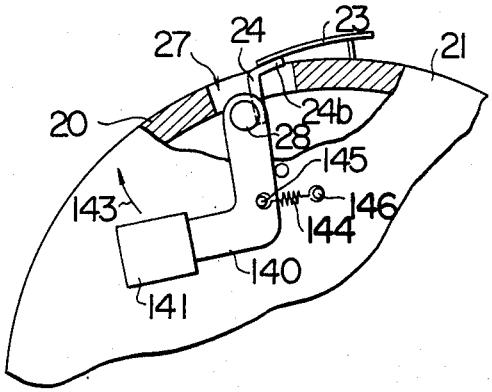
FIG. 31 is a side elevation, partly cut away, of one form of means for urging the sheet seizing claw.

FIG. 31 illustrates an arrangement for assuring a reliable sheet clamping action by the sheet seizing claw 23. As shown, the pivot 28 for the claw 23 has its outer ends projecting externally of the flanges 21. A substantially L-shaped lever 140 has its one end fixedly mounted on the outer end of each pivot end, and the other end of the lever 140 fixedly carries a weight 141. Since the weight 141 is located on the opposite side of the pivot 28 from the claw 23, a spring 144 extends between a pin 145 fixedly mounted substantially at the mid-length of the lever 140 and a pin 146 fixedly mounted on the outside of the flange so that the claw is maintained open when it has turned into a location below the rotating shaft.

In operation, as the rotational speed of the drum 20 increases after a sheet has been held thereagainst, the centrifugal force acting on the weight 141 causes it to move in a direction indicated by an arrow 143, whereby the lever 140 acts to urge the claw 23 to be more strongly biased against the drum surface. Since the magnitude of the bias is proportional to the square of the rotational speed, the sheet clamping action is advantageously improved with an increase in the speed of rotation of the drum.

Figure 33:
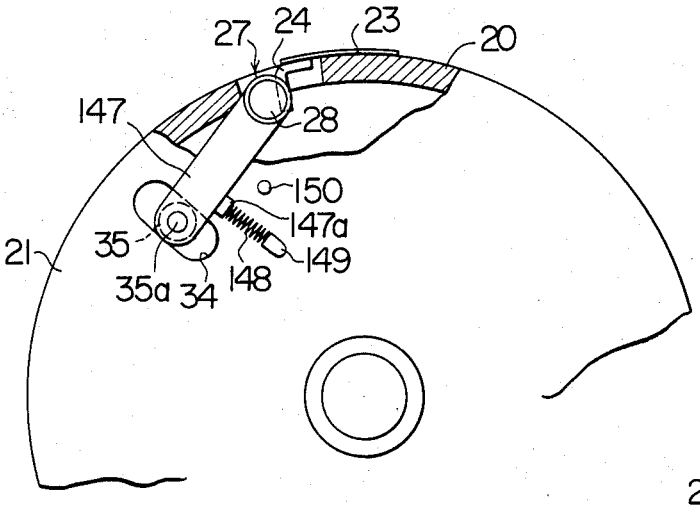
FIG. 33 is a side elevation of another form of means for urging the sheet seizing claw.
Figure 34:
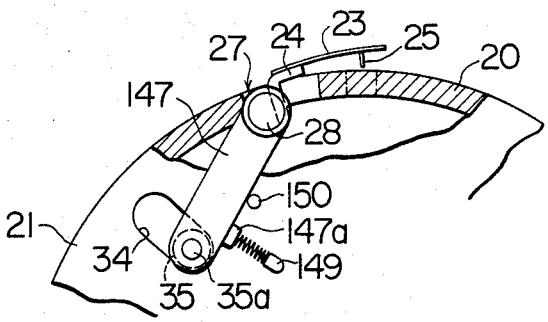
FIG. 34 illustrates the operation of the means shown in FIG. 33.
Figure 35:
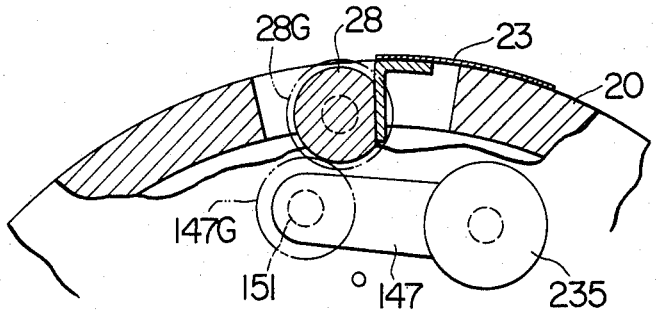
FIG. 35 is a side elevation of a further form of means for urging the sheet seizing claw.

FIGS. 33 to 35 illustrate still another embodiment of the invention. In this instance, a weight is disposed so as to be movable into the drum 20, in contradistinction to the embodiment shown in FIG. 31. Specifically, a weight 35 in the form of a round rod is disposed across substantially the entire length of the drum, and fixedly carries support shafts 35*a* on its opposite ends, which extend through elongate slots 34 formed in the flanges 21 to project externally thereof. One end of a lever 147 is fixedly mounted on each support shaft 35*a* while the other end of the lever 147 is fixedly mounted on the pivot 28. The pivot 28 is disposed in the slit 27 and is rotatably carried by the opposite flanges. As before, an L-shaped bracket 24 has its one limb fixedly mounted on the pivot while its other limb is secured to the adjacent end of the claw 23.

A spring 148 which normally urges the lever 147 clockwise about the pivot 28, as viewed in FIG. 33, extends between a detent 147*a* and an anchorage 149 formed on the flange of the drum. In the position of the sheet seizing claw 23 shown in FIG. 34 where it is removed from the drum surface and to which it is brought by a mechanism, not shown, the lever 147 bears against a stop 150. The operation of the embodiment is basically the same as that of the previous embodiments, but there is provided an additional advantage that since the weight 35 can be received within the drum over its entire length, it is a simple matter to increase the mass of the weight to enhance the sheet clamping capability.

FIG. 35 illustrates a modification in that the lever functioning as the connection means to convert a movement of a weight into a rocking motion of the sheet seizing claw is replaced by a gear 28G fixedly mounted on the end of the pivot 28 which rockably supports the claw 23. Another gear 147G is fixedly mounted on a support shaft 151 which is in turn rotatably mounted on the drum flange, the gear 147G meshing with the gear 28G. A weight 235 is fixedly mounted on the other end of a lever 147 which has its other end fixedly connected with the gear 147G. In this arrangement, as the drum 20 rotates, the weight 235 moves counterclockwise, as viewed in FIG. 35, about the support shaft 151, whereby the meshing engagement between the gears 147G, 28G cause the claw 23 to rotate clockwise, as viewed in FIG. 35, thus achieving the same effect as mentioned previously.

Figure 36:
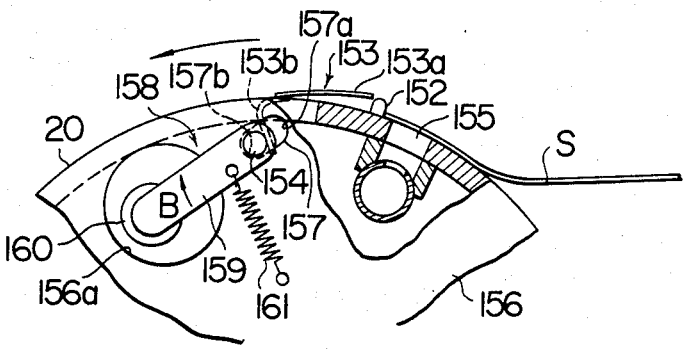
FIG. 36 is a side elevation of one form of means for supporting the sheet seizing claw.
Figure 37:
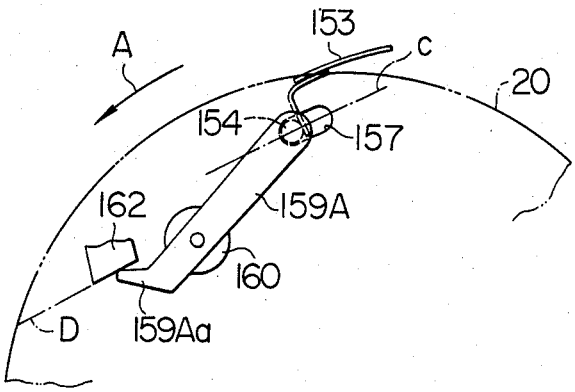
FIG. 37 is a side elevation of another form of support means.

After the completion of a printing operation, the sheet is separated from the drum surface by bringing the separation roller 16 (see FIG. 1) into abutment against the sheet to extract the leading end of sheet from below the claw 23. The separation of a sheet takes place during a low speed rotation of the drum, so that in the embodiment shown in FIG. 3, the claw 23 is brought to its open position as illustrated in FIG. 11. However, to release the leading end of a sheet from the claw, there must be a certain degree of "slack" in the sheet. On the other hand, the presence of the slack may cause inconvenience that the sheet may move in contact with a sheet guide plate (not shown) or the ink jet head 12 (FIG. 1), causing the image surface to be rubbed. FIGS. 36 and 37 illustrate an embodiment which reliably releases the sheet from the drum without causing a contamination thereof during a sheet separating operation.

Initially referring to FIG. 36, the drum 20 is provided with a stop 152 at a given location downstream, as viewed in the direction of rotation of the drum indicated by an arrow A, of the suction holes 36. The stop 152 is vertically movable to be recessed into or projected above the drum surface. It is normally urged to project above the drum surface. When a sheet seizing claw 153 is open as shown, the stop 152 assumes its projecting position while it can be recessed into the drum whenever the claw is closed. The sheet seizing claw 153 is formed with a plurality of pairs of claw ends 153*a* and base ends 153*b* in substantially integral manner with a common pivot 154, generally in alignment with each of a plurality of sheet suction holes 155 formed along a generatrix of the drum surface.

The drum 20 is substantially integrally formed with flanges 156 (only one being shown), in which a pair of elongate slots 157 are formed in opposing relationship with each other. The slots 157 are oblong in a direction such that the center of the drum is approached when advancing in the direction of rotation A.

The location of the elongate slots 157 is chosen such that the claw ends 153*a* are fully capable of blocking the suction hole 155 whenever the pivot 154 bears against the upstream end 157*a* while the claw ends 153*a* are fully clear of the leading end of the sheet whenever the pivot 154 bears against the downstream end, as viewed in the direction of rotation of the drum, or the left-hand end 157*b* of the slots.

Displacement means 158 principally comprises a lever 159, a weight 160 and a spring 161. Secured to one end of the lever 159 is the end of the pivot 154 while the weight 160 having a suitable mass is secured to the other end of the lever. The weight 160 is movable in an opening 156*a* formed in the flange 156 of the drum to avoid an interference with a movement of the pivot 154 in the elongate slots 157 to rock the claw end 153*a* about the pivot in order to open or close the sheet. The spring 161 has its opposite ends anchored to the lever 159 and the flange 156, and normally urges the pivot 154 into abutment against the end 157*b* of the slots. The resilience of the spring 161 is chosen so that in the drum position shown in FIG. 1, for example, the pivot 154 is maintained in abutment against the end 157*b* of the slots during a rotation of the drum at a low speed of approximately 30 rpm in the same manner as when the drum is at rest while a centrifugal force acting upon the weight 160 during a high speed rotation at approximately 1,000 rpm causes the pivot 154 to bear against the opposite end 157*a* of the slots to cause the lever 159 to rock clockwise, or in a direction indicated by an arrow B, about the pivot 154 so that the claw ends 153*a* are able to clamp the leading end of a sheet in a reliable manner.

As a result of the described arrangement, during the rotation of the drum at a low speed, the spring 161 causes the pivot 154 to be retracted into abutment against the left-hand end 157*b* of the slots 157 and causes the claw to rock counterclockwise about the pivot 154, thus opening the claw end 153*a*. Under this condition, the leading end of the sheet is exposed out of the claw 153. Hence, during a delivery operation, the suction applied to the suction holes 155 may be interrupted, whereupon the resilience and the weight of the sheet alone is sufficient to allow it to be separated from the drum surface for delivery. It is entirely unnecessary to displace the leading end of the sheet or to push it outward from inside the drum.

When the speed of the rotation of the drum increases, the centrifugal force of the entire displacement means 158 overcomes the resilience of the spring 161 to cause the pivot 154 to be displaced into abutment against the right-hand end 157*a* of the slots, and also causes the claw to be turned clockwise about the pivot 154, thus clamping the sheet. The centrifugal force of the entire displacement means is properly chosen in proportion to the centrifugal force of the weight acting to close the claw to prevent a reverse of such sequence of movement.

FIG. 37 shows a still further embodiment of the invention which is preferred for use when said proportion cannot be properly achieved for reason of mechanical construction. Specifically, a weight 160 is fixedly mounted on one end of a lever 159A, which end is extended, and a guide member 162 is disposed on the flange 156 (see FIG. 36) so that it bears against the extension 159A*a* when a sheet seizing claw 153 is open. The guide member 162 has an abutment surface D which is parallel to the direction C of the slots 157. Hence, when the drum 20 changes from a low speed to a high speed rotation, the pivot 154 initially moves into abutment against the right-hand end 157*a* of the slots as guided by these slots and the guide member 162. In the meantime, the end of the lever 159A on which the weight is located or the extension 159A remains in contact with the guide member 162, and hence cannot pivot. However, when it further moves along the slots and the claw is located in position to clamp the leading end of the sheet, the extension 159A*a* is clear of guide member 162 to permit a clockwise rocking motion of the lever 159A. In this manner, a proper sequence of longitudinal movement followed by the rocking motion of displacement means is assured, preventing a reverse thereof from occurring.

Figure 38:
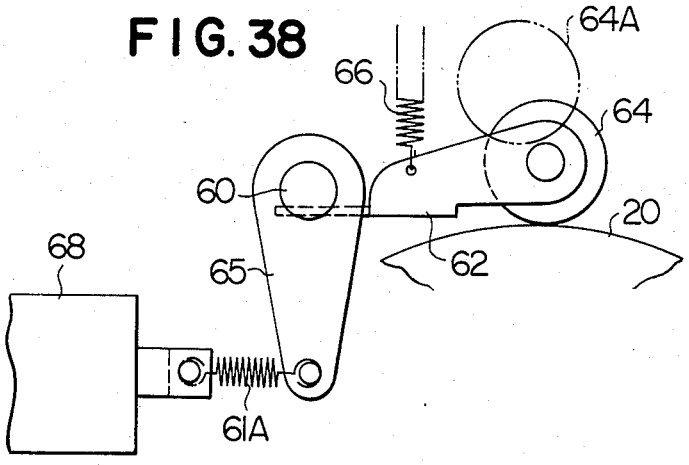
FIGS. 38 and 39 are side elevations illustrating different forms of a hold down device.

Returning to FIGS. 23 and 24, it is to be understood that the hold-down device 59 is arranged such that the roller 64 bears against the drum surface with a constant pressure as a result of a flexure of the leaf spring 61 by choosing a stroke for the solenoid 68 which is slightly greater than the distance travelled by the roller 64 as it moves from its first position (FIG. 24) to its second position (FIG. 23). Instead of interposing the leaf spring 61 between the roller 64 and the solenoid which represents drive means for causing a movement of the roller, a helical spring 61A as shown in FIG. 38 may be disposed between the lever 65 and the solenoid 68 to maintain a constant pressure with which the roller 64 bears against the drum surface as before as shown in FIG. 38.

Figure 39:
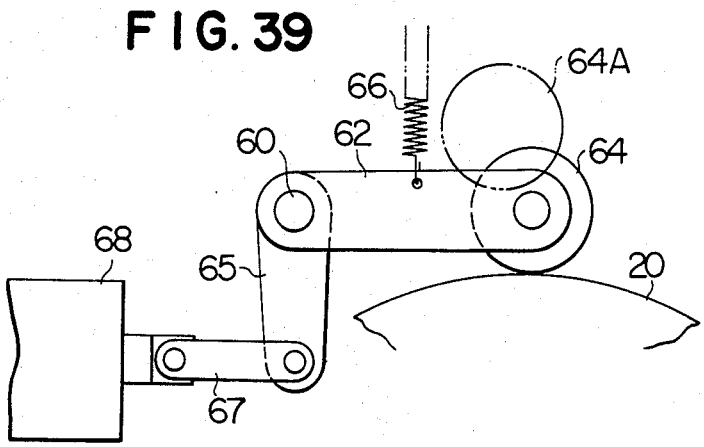

If a stroke of the solenoid 68 can be chosen which is equal to the length of travel of the roller 64, the support arm 62 and the lever 65 may be integrally connected together, with the lever 65 and the solenoid 68 being interconnected by a link 67, as shown in FIG. 39. In FIGS. 38 and 39, a reference character 64A represents the first position while the solid line position represents the second position of the roller 64.

While in the foregoing description, drive means for selectively locating the roller 64 at its first and its second position comprises the spring 66 and the solenoid 68, any other means may alternatively be employed. By way of example, a solenoid of rotary type may be disposed on the pivot 60 to cause the latter to rotate through a given angle directly.

What is claimed is:

1. A sheet clamping device for holding a sheet around a drum, comprising a plurality of rows of sheet suction holes formed in the peripheral surface of a drum to provide communication between the interior and the exterior of the drum, the rows being spaced apart circumferentially of the drum, suction means including only one vacuum pump communicating with the suction holes of the respective rows for applying suction to said holes to withdraw air into the interior of the drum, and means for controlling the timing of application of suction to the respective rows of sheet suction holes, thereby beginning the attraction of different parts of the sheet to the drum from inside the drum at different times.

2. A sheet clamping device according to claim 1 in which the rows of sheet suction holes include a row of suction holes for attracting the leading end of the sheet and another row of suction holes for attracting the trailing end of the sheet.

3. A sheet clamping device according to claim 1 in which the sheet suction holes are disposed in a plurality of rows each extending along the generatrix of the drum, the suction holes being disposed in an area of the drum which depends on the width of a sheet to be attracted, those suction holes which attract the leading end of sheets having a same width ae used in common while those suction holes corresponding to sheets having a different size being spaced circumferentially of the drum.

4. A sheet clamping device according to claim 1 in which the drum is selectively driven for rotation at either a low or a high speed.

5. A sheet clamping device according to claim 1 in which the drum is driven for rotation by a drive motor which is directly coupled with a drum shaft located in alignment with the center of rotation of the drum.

6. A sheet clamping device according to claim 1 in which the drum shaft comprises a support shaft integrally secured to a flange of the drum.

7. A sheet clamping device according to claim 1 in which the controller comprises an encoder directly coupled with a drum support shaft.

8. A sheet clamping device according to claim 1 in which the pump is connected to a pair of solenoid valves each operable to apply a suction to attract the leading and the trailing end of the sheet.

9. A sheet clamping device according to claim 1 or 2 in which a sheet seizing claw is mounted on the drum at a location downstream of the sheet suction holes, as viewed in the direction of rotation thereof; and means including a row of suction holes located beneath said claw are provided for attracting the leading end of a sheet placed under said claw and also for attracting said claw to said sheet.

10. A sheet clamping device according to claim 9 in which the sheet seizing claw includes a sheet stop against which the leading edge of a sheet abuts.

11. A sheet clamping device according to claim 9 in which the sheet seizing claw is rockably mounted on a pivot which is in turn mounted on a flange of the drum.

12. A sheet clamping device according to claim 9 in which said sheet seizing claw is mounted on pivots supported in elongated slots formed in side walls of said drum, said elongate slots extending generally toward the axis of rotation of the drum.

13. A sheet clamping device according to claim 9 in which the sheet seizing claw comprises a resilient blade having substantially the same curvature as the drum surface.

14. A sheet clamping device according to claim 13, further including a sheet stop which is located to cause substantially one-half the sheet suction holes in one of the plurality of rows to be blocked whenever the leading end of the sheet abuts against the sheet stop.

15. A sheet clamping device according to claim 13, further including a sheet stop which is movable into a stop advance hole formed in the drum.

16. A sheet clamping device according to claim 15 in which a pivot is urged in a direction to cause the sheet clamping claw which is secured thereto to move to its unclamp position in the direction of rotation of the drum.

17. A sheet clamping device according to claim 15 in which a pivot is connected to a weight which functions to apply the sheet clamping claw secured to the pivot a centrifugal force developed during a high speed rotation of the drum so that the claw bears against the drum surface.

18. A sheet clamping device according to claim 9 further including means connected to said sheet seizing claw for urging it resiliently away from the drum surface.

19. A sheet clamping device according to claim 18 in which the sheet seizing claw is urged to move away from the drum surface by a tension spring extending between a lever fixedly mounted on a pivot and a flange of the drum.

20. A sheet clamping device according to claim 18 including urging means for closing said claw tightly during high speed rotation of said drum, said urging means including a weight disposed within the drum and connected to said sheet seizing claw, said weight being movable outwardly during high speed rotation of said drum to move said claw towards the drum surface by centrifugal force.

21. A sheet claiming device according to claim 18 including urging means for closing said claw by centrifugal force, said means including a weight fixedly mounted on one end of a lever fixedly mounted on a pivot carrying said sheet seizing claw, the weight being located laterally outside a flange of the drum.

22. A sheet clamping device according to claim 18 further comprising means including a weight and connection means disposed between the sheet seizing claw and the weight for transmitting a centrifugal force developed on the weight during a high speed rotation of the drum, to the sheet seizing claw to cause it to bear against the drum surface.

23. A sheet clamping device according to claim 18 in which a movement of the sheet seizing claw away from the drum surface as it is urged in such direction is limited by a lever fixedly mounted on a pivot and a stop fixedly mounted on a flange of the drum.

24. A sheet clamping device according to claim 1, further comprising means selectively located at a location adjacent the drum surface and another location remote from the drum surface for holding the sheet down against the surface of the drum.

25. A sheet clamping device according to claim 24 in which the holding means comprises a roller movable in a direction toward or away from the drum surface, a support arm for rotatably carrying the roller, and drive means for causing a rocking motion of a support arm to move the roller toward or away from the drum surface.

26. A sheet clamping device according to claim 25 in which the roller is formed of an elastic material such as a rubber or similar material.

27. A sheet clamping device according to claim 25 in which the roller has substantially the same axial length as the drum.

28. A sheet clamping device according to claim 25 in which the support arm is connected to the drive source through a resilient blade such as a leaf spring.

29. A sheet clamping device according to claim 25 in which the support arm is connected to the drive source through a coiled spring.

30. A sheet clamping device according to claim 25 in which the drive comprises a solenoid.

31. A sheet clamping device according to claim 1 in which the plurality of rows of sheet suction holes communicate with the suction means through a suction pipe and air passage both disposed within the drum.

32. A sheet clamping device according to claim 31 in which the suction pipe is secured to the internal surface of the drum through a pipe holder interposed therebetween.

33. A sheet clamping device according to claim 31 in which the air passage comprises a first air passage formed in a flange of the drum and having its one end communicating with the suction pipe, and a second air passage formed in a drum shaft substantially integral with the drum and having its one end communicating with the other end of the first air passage and its other end connected to the suction means.

34. A sheet clamping device according to claim 33, in which the second air passage comprises a groove formed in the peripheral surface of a hollow shaft mounted on a flange of the drum, and another groove formed in the outer peripheral surface of a drum shaft which is in alignment with the center of rotation of the drum, the second air passage having its one end communicating with the first air passage and its other end opening into the outer periphery of the hollow shaft.

35. A sheet clamping device according to claim 33 in which the first air passage comprises a recess formed in a flange of the drum to extend radially thereof, and a rubber gasket and a keeper plate which hermetically cover the recess.

36. A sheet clamping device according to claim 35 in which the second air passage is provided on the opposite ends of the drum.

37. A sheet clamping device according to claim 35 in which the second air passage is provided on one end of the drum.

38. A sheet clamping device according to claim 33 in which the second air passage is defined by a hollow drum shaft and has its one end communicating with the first air passage and its other end opening into the end of the shaft.

39. A sheet clamping device according to claim 38 in which the hollow shaft is fitted into a pair of bearings of a sealing type on the opposite side of the opening, the bearings being supported by a bearing housing, the outer periphery of the hollow shaft, the pair of bearings and the bearing housing defining an annular space therebetween, the bearing housing being formed with connection which communicates with the suction means.

40. A sheet clamping device according to claim 1 in which said drum includes an axial shaft extending from a side wall of the drum, said shaft being hollow.

41. A sheet clamping device according to claim 40 in which the drum shaft is rotatably carried by a bearing of a sealing type.

42. A sheet clamping device according to claim 1 in which said drum includes an axial shaft secured integrallyto a side wall of said drum.

43. A sheet clamping device according to claim 42 in which the drum support shaft is normally urged in one axial direction, thus positioning the drum.

44. A sheet clamping device according to claim 1 or 2 in which a sheet seizing claw is mounted on the drum at a location downstream of the sheet suction holes, said claw being urged gently away from the drum for receiving a leading edge of a sheet thereunder, and wherein a row of suction holes located beneath said claw serve to attract the leading end of a sheet placed under said claw and also attract said claw to said sheet.

45. A sheet clamping device according to claim 44 including a suction pipe within the drum for communicating with suction holes adapted to attract the leading end of the sheet, and wherein suction holes associated with the sheet seizing claw communicate with said suction pipe.

46. A sheet clamping device according to claim 44 in which the sheet seizing claw is supported by being secured to a rigid support held to said drum.

47. A sheet clamping device according to claim 46 in which the support is fitted into a groove formed in the dum surface along the generatrix thereof.

48. A sheet clamping device according to claim 47 in which the support for the sheet seizing claw is L-shaped in cross section, the support being folded in a direction to prevent an ingress of air into the clearance between the drum surface and the clamped leading end of the sheet during rotation of the drum.

49. A sheet clamping device for holding a sheet around a drum, comprising a plurality of rows of sheet suction holes formed in the peripheral surface of a drum to provide communication between the interior and the exterior of the drum, the rows being spaced apart circumferentially of the drum, suction means communicating with the suction holes of the respective rows for applying suction to said holes to withdraw air into the interior of the drum, means controlling the timing of application of sucton to the respective rows of sheet suction holes, thereby beginning the attraction of different parts of the sheet to the drum from inside the drum at different times, a sheet seizing claw pivotally mounted to the drum in space relation therewith, means connected to said claw for urging it resiliently away from the drum surface, and holding means for bringing said claw towards said drum surface for holding a sheet thereto; said holding means including a number of said sheet suction holes being disposed to attract said claw to said drum surface when the leading edge of a sheet is first attracted by suction to said drum.

50. A sheet clamping device according to claim 49, one row of said sheet suction holes being overlaid by the leading edge of a sheet held to said drum and said claw being attracted to said drum by suction applied to another row of holes connected to said suction means at the same time as said one row of holes, whereby as the leading edge of the sheet covers the holes of said another row, the suction applied to said one row will increase in an amount sufficient to attract said claw to said drum surface.

51. A sheet clamping device according to claim 49, said holding means including a weight connected to said claw to pivot said claw toward said drum surface during high speed rotation of the drum.

52. A sheet clamping device according to claim 49, said holding means including a weight connected to said claw to pivot said claw toward said drum surface during high speed rotation of the drum; said weight being connected with a gear meshing with a gear connected to said claw whereby movement of said weight outwardly will turn said gears to pivot said claw.

53. A sheet clamping device according to claim 49, stop means for positioning a sheet relative one row of said sheet suction holes so that the holes of said one row are partially overlaid by the leading edge of a sheet held to said drum to apply suction forces to said claw.

54. A sheet clamping device according to claim 53, said stop means including a row of stop holes extending along the surface of said drum between adjacent holes of said one row, and a portion of said claw extending within said stop holes when said claw is away from the drum surface.

55. A sheet clamping device according to claim 54, said suction means including a respective suction pipe extending beneath each row of holes and a respective pipe holder secured to the inner surface of said drum for holding each pipe in position, one of said pipe holders serving to block said stop holes.

56. A sheet clamping device according to claim 49, said holding means including a weight connected to said claw to pivot said claw toward said drum surface during high speed rotation of the drum; said weight being connected integrally to said claw by a lever.

57. A sheet clamping device according to claim 56, further including means for preventing said weight from shifting in position to close said claw until after said drum has turned through a predetermined angle.

58. A sheet clamping device for holding a sheet around a drum, comprising a plurality of rows of sheet suction holes formed in the peripheral surface of a drum to provide communication between the interior and the exterior of the drum, the rows being spaced apart circumferentially of the drum, suction means communicating with the suction holes of the respective rows for applying suction to said holes to withdraw air into the interior of the drum, means controlling the timing of application of suction to the respective rows of sheet suction holes, thereby beginning the attraction of different parts of the sheet to the drum from inside the drum at the different times, and a sheet seizing claim pivotally mounted to the drum in space relation therewith, and means including a weight connected to said claw for pivoting said claw toward the drum during high speed rotation of the drum to hold a sheet between said claw and said drum.

* * * * *